US008242681B2

(12) United States Patent
Tagawa et al.

(10) Patent No.: US 8,242,681 B2
(45) Date of Patent: Aug. 14, 2012

(54) DISPLAY PANEL AND IMAGE DISPLAY APPARATUS

(75) Inventors: Motoki Tagawa, Chigasaki (JP); Toshimitsu Kawase, Ebina (JP); Kinya Kamiguchi, Kamakura (JP); Ryo Ohtomo, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 12/764,414

(22) Filed: Apr. 21, 2010

(65) Prior Publication Data

US 2010/0288524 A1 Nov. 18, 2010

(30) Foreign Application Priority Data

May 15, 2009 (JP) ..... 2009-118971

(51) Int. Cl.
*H01J 17/49* (2006.01)

(52) U.S. Cl. ..... 313/495; 313/497

(58) Field of Classification Search ..... 313/495–497, 313/582–587

See application file for complete search history.

(56) References Cited

U.S. PATENT DOCUMENTS

| | | | | |
|---|---|---|---|---|
| 5,578,899 | A * | 11/1996 | Haven et al. | 313/422 |
| 5,821,689 | A | 10/1998 | Andoh et al. | |
| 6,342,875 | B2 | 1/2002 | Todokoro | |
| 6,831,619 | B2 | 12/2004 | Todokoro | |
| 7,088,036 | B2 | 8/2006 | Kanda et al. | |
| 7,304,429 | B2 | 12/2007 | Kawase | |
| 7,390,235 | B2 | 6/2008 | Kanda et al. | |
| 7,692,370 | B2 | 4/2010 | Murata et al. | |
| 2001/0043170 | A1 | 11/2001 | Todokoro | |
| 2006/0082272 | A1 * | 4/2006 | Kim et al. | 313/46 |
| 2006/0098136 | A1 | 5/2006 | Masunaga et al. | |
| 2008/0096455 | A1 | 4/2008 | Kawase | |
| 2008/0116782 | A1 * | 5/2008 | Kim et al. | 313/496 |
| 2008/0122339 | A1 | 5/2008 | Murata et al. | |
| 2008/0227358 | A1 | 9/2008 | Kanda et al. | |
| 2009/0154077 | A1 | 6/2009 | Kamiguchi | |
| 2009/0225505 | A1 | 9/2009 | Kamiguchi | |

FOREIGN PATENT DOCUMENTS

| | | |
|---|---|---|
| JP | 10-326580 A | 8/1998 |
| JP | 2005-011764 A | 1/2005 |
| JP | 2005-227766 A | 8/2005 |
| JP | 2006-185723 A | 7/2006 |

* cited by examiner

*Primary Examiner* — Anne Hines
(74) *Attorney, Agent, or Firm* — Fitzpatrick, Cella, Harper & Scinto

(57) ABSTRACT

A display panel includes a vacuum vessel provided with a face plate, a rear plate having a first surface that opposes the face plate at an interval therefrom, a connecting member provided between the face plate and the rear plate and connecting the face plate and the rear plate, and a plurality of plate-like spacers provided between the face plate and the rear plate so that lengthwise directions thereof are parallel to each other. In addition, a plurality of linear fixing members are adhered to the vacuum vessel by a plurality of linear bonding members. The fixing members are adhered to the rear plate by the linear bonding members at mutually prescribed intervals and along the lengthwise direction of the plurality of spacers, with each of the plurality of linear fixing members provided with a plate-like member adhered to the rear plate and a plurality of protruding portions provided on a surface of the plate-like member on an opposite side from the rear plate.

6 Claims, 11 Drawing Sheets

DISPLAY PANEL AND IMAGE DISPLAY APPARATUS

BACKGROUND OF THE INVENTION

1. Field of the Invention

The present invention relates to a display panel and an image display apparatus provided with a flat, rectangular vacuum vessel.

2. Description of the Related Art

Image display apparatuses such as a field emission display (FED) are known that are of a type in which electrons emitted from electron-emitting devices are radiated onto a light emitter such as a phosphor. Such image display apparatuses use a display panel provided with a flat, rectangular vacuum vessel in which the interior thereof is maintained at a pressure lower than atmospheric pressure (vacuum). In order to maintain the internal space in a vacuum, a plurality of spacers are typically provided within the flat, rectangular vacuum vessel.

In an image display apparatus having a display panel provided with a flat, rectangular vacuum vessel in this manner, it is required to prevent the vacuum vessel from being damaged by impact applied to the image display apparatus. In addition, it is also required to not only prevent damage to the exterior of the vacuum vessel, but also to prevent damage to members relating to image display located within the vacuum vessel. Examples of impact that causes damage to the vacuum vessel include impact to the image display apparatus from the outside, impact occurring during transport or installation, and impact caused by dropping due to careless handling.

Japanese Patent Application Laid-open No. 2005-011764 discloses a reinforcement frame attached to the back (side on the opposite side from the display side) of a vacuum vessel that composes a display panel in order to improve the mechanical strength of the vacuum vessel. In addition, Japanese Patent Application Laid-open No. 2005-227766 discloses the adhesion of a reinforcement frame to a vacuum vessel with a plurality of adhesives. Japanese Patent Application Laid-open No. 2006-185723 discloses a vacuum vessel provided with long, narrow plate-like spacers arranged so that each of the lengthwise directions thereof are parallel. A mode is disclosed therein in which long, narrow plate-like spacers are contacted in a plurality of spacer contact layers intermittently provided on a metal back layer that covers a light-emitting surface. In addition, Japanese Patent Application Laid-open No. H10-326580 discloses the providing of a protective plate on a display surface of a vacuum vessel that composes a display panel.

In Japanese Patent Application Laid-open No. 2005-227766, adhesive is also provided in a direction perpendicular to the lengthwise direction of the plate-like spacers. Consequently, dropping impact and the like lead to damage to the plate-like spacers and contact members in contact with the plate-like spacers, and this may cause deterioration of display images. In addition, in Japanese Patent Application Laid-open No. 2005-227766, adhesive is provided to the edges of the vacuum vessel. Consequently, impact is applied to the vacuum vessel through the reinforcement frame during transport or caused by dropping and the like, and impact is transmitted directly to the edges in which bending occurs, thereby leading to damage to the edges. In addition, when adhering the reinforcement frame to the edges in which bending occurs, variations in the thickness of the adhesive or pressing force applied during adhesion and the like can also lead to damage to the edges.

SUMMARY OF THE INVENTION

The present invention provides an image display apparatus capable of inhibiting damage to plate-like spacers, contact members contacted by the plate-like spacers, and the edges of a vacuum vessel.

The present invention in its first aspect provides a display panel including: a vacuum vessel provided with a face plate, a rear plate having a surface that opposes the face plate at an interval therefrom, a connecting member that surrounds a space between the face plate and the rear plate, is provided between the face plate and the rear plate and connects the face plate and the rear plate, and a plurality of plate-like spacers provided between the face plate and the rear plate so that the lengthwise directions thereof are parallel to each other, and a fixing member adhered to the vacuum vessel by a plurality of linear bonding members provided on a surface of the rear plate on the opposite side from the surface opposing the face plate, wherein each of the plurality of linear bonding members is provided to the rear plate at mutually prescribed intervals and along the lengthwise direction of the plurality of spacers, and the plurality of linear bonding members are provided only in a portion of a region on the surface of the rear plate on the opposite side from the surface opposing the face plate, the portion of the region being located on the opposite side from the region surrounded by the connecting member on the surface of the rear plate that opposes the face plate.

The present invention in its second aspect provides an image display apparatus including: the display panel; and a supporting member that supports the vacuum vessel composing the display panel, by means of the fixing members.

According to the present invention, an image display apparatus can be provided that is capable of inhibiting damage to plate-like spacers, contact members contacted by the plate-like spacers, and the edges of a vacuum vessel. In addition, a display panel and image display apparatus can be provided that are capable of realizing reduced thickness, light weight and low costs.

Further features of the present invention will become apparent from the following description of exemplary embodiments with reference to the attached drawings.

DESCRIPTION OF THE EMBODIMENTS

The following provides an explanation of embodiments of the present invention The present invention is effective for use in a display panel provided with a flat, rectangular vacuum vessel 10 as shown in FIG. 11, and an image display apparatus that uses that display panel. In particular, the present invention is effective for use in an image display apparatus and display panel that requires alleviation of deformation of the vacuum vessel 10 in a specific direction and alleviation of generation of stress in a specific direction during dropping impact and the like. The interior of the flat, rectangular vacuum vessel 10 is maintained at a pressure lower than atmospheric pressure, and has a plurality of long, narrow plate-like spacers 14 having for the lengthwise direction thereof the same direction as the lengthwise direction (first direction X) of the flat, rectangular vacuum vessel 10.

A display panel refers to a so-called display module, and is at least provided with the vacuum vessel 10, fixing members for fixing the vacuum vessel 10 to a supporting member, and bonding members that adhere the fixing members to the vacuum vessel. Moreover, the display panel is also typically provided with a drive circuit within the vacuum vessel for driving an electron-emitting device and an anode electrode. On the other hand, an image display apparatus refers to an apparatus that is at least provided with a supporting member for placing the display panel on an installation surface in addition to the display panel. Moreover, an image display apparatus also refers to an apparatus provided with a receiver for receiving television signals, an image processing circuit for carrying out a prescribed processing according to input image signals and characteristics of the display panel, and speakers and the like as necessary.

Figure 11A:
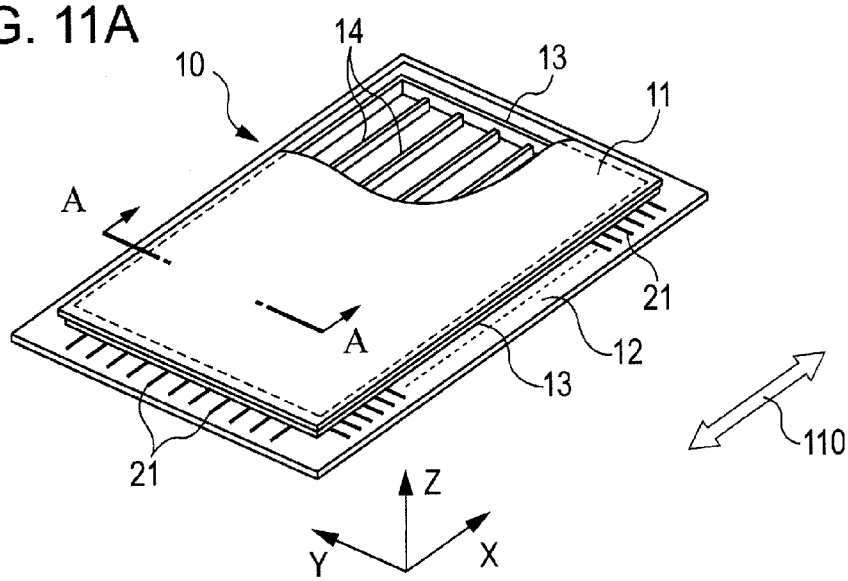
FIGS. 11A to 11C are schematic diagrams of a display panel.
Figure 11B:
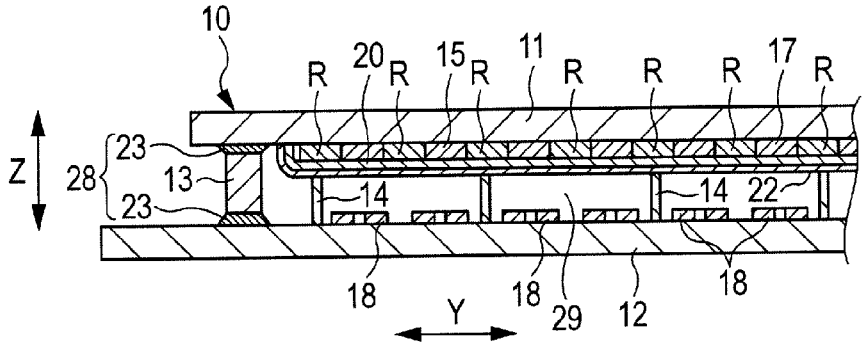
Figure 11C:
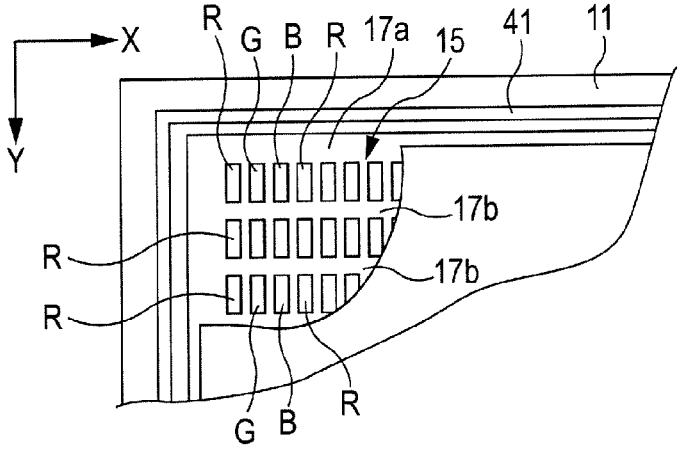

An explanation is first provided of a display panel to which the present invention is preferably applied using FIGS. 11A to 11C. FIG. 11A is a perspective view schematically showing a partial cutaway of the vacuum vessel 10 that composes the display panel, and FIG. 11B is a cross-sectional schematic drawing taken along line A-A of FIG. 11A. In addition, FIG. 11C is a schematic diagram of a portion of a face plate 11 when viewed from a rear plate 12. An example of such a display panel is a field emission display (FED). As shown in FIGS. 11A and 11B, the vacuum vessel 10 is provided with the face plate 11 and the rear plate 12 respectively composed of rectangular glass plates, and a connecting member 28 provided between the face plate 11 and the rear plate 12. The connecting member 28 is in the form of a rectangular frame that connects the face plate 11 and the rear plate 12. The connecting member 28 defines an internal space 29 of the vacuum vessel 10 by surrounding the space between the face plate 11 and the rear plate 12. In the internal space 29 of the vacuum vessel 10, the face plate 11 and the rear plate 12 are arranged in mutual opposition at a prescribed interval (such as a gap of 1 to 2 mm). Consequently, the internal space 29 of the vacuum vessel 10 can be said to be a space that is encompassed by the face plate 11, the rear plate 12 and the connecting member 28. Within the internal space 29 of the vacuum vessel 10, the interval between the face plate 11 and the rear plate 12 is maintained at, for example, not less than 200 μm and not more than 3 mm, and more practically, at not less than 1 mm and not more than 2 mm. The thickness of the face plate 11 and the rear plate 12 is 0.5 to 3 mm and preferably 2 mm or less. The internal space 29 of the vacuum vessel 10 is maintained at high pressure of about $10^{-4}$ Pa or less. Those portions of the face plate 11 and the rear plate 12 farther to the inside than the outer periphery can be connected by a rectangular frame-shaped side wall 13 and the connecting member 28 composed of bonding members 23 provided on portions of the side wall 13 that oppose the face plate 11 and the rear plate 12. The side wall 13 can be composed of, for example, glass or metal. In addition, an adhesive provided with a function for sealing low melting point glass or low melting point metal and the like can be used as the bonding members 23. The bonding members 23 seal the portion of the face plate 11 farther to the inside than the periphery thereof and the portion of the rear plate 12 farther to the inside than the periphery thereof by adhering the side wall 13 to the face plate 11 and the rear plate 12, thereby connecting these plates. Here, although an example is shown in which the connecting member 28 is composed of the side wall 13 and the bonding members 23, the side wall 13 can also be omitted depending on the interval between the face plate 11 and the rear plate 12. Namely, there are no limitations on the structure of the connecting member 28 provided it is able to connect the face plate 11 and the rear plate 12 while also surrounding the space between the face plate 11 and the rear plate 12 and maintaining the air tightness thereof.

Figure 4:
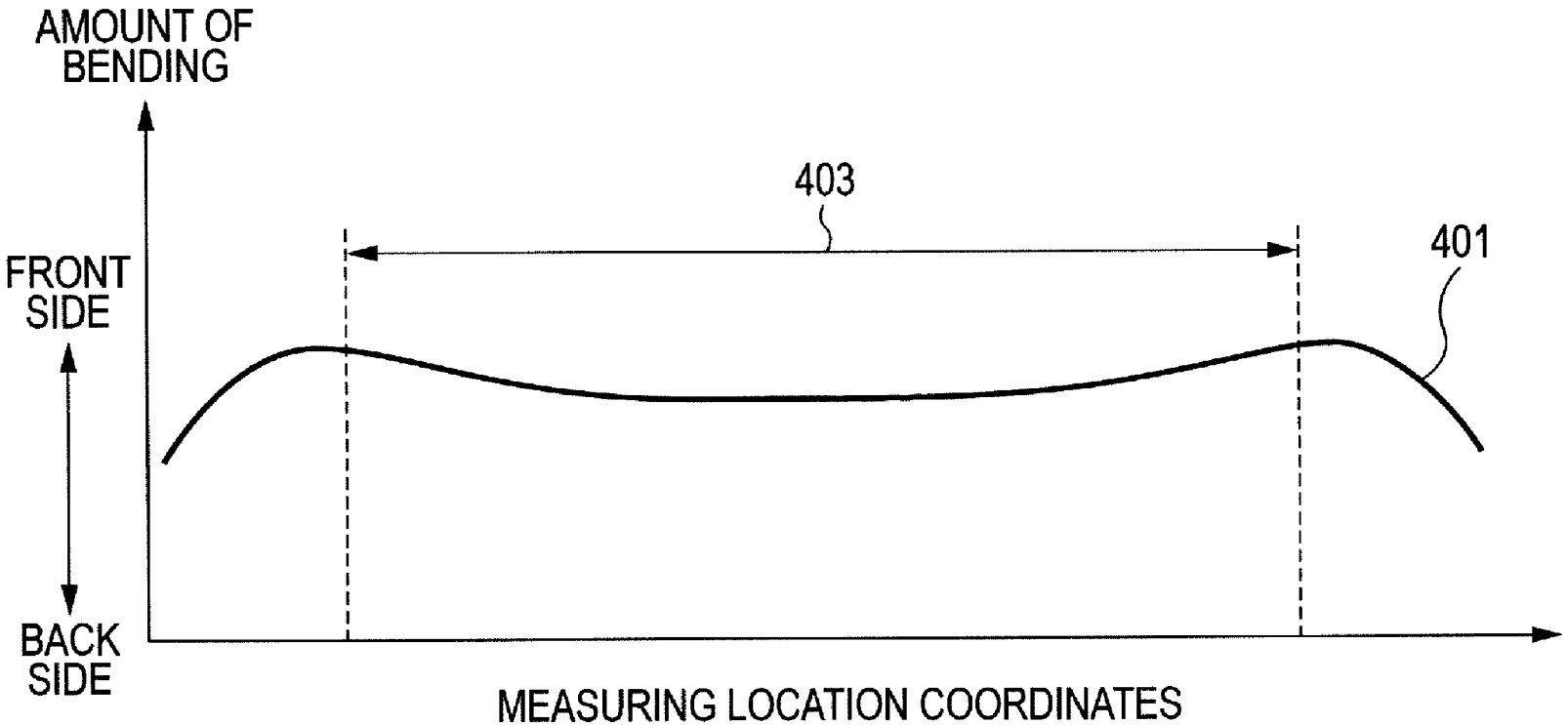
FIG. 4 is a schematic diagram showing another form of a bent shape of a display panel.

Furthermore, the connecting member 28 is provided at a prescribed distance away from each periphery of the face plate 11 and the rear plate 12 so as to be located farther to the inside than each periphery. Consequently, a space (internal space) maintained in vacuum, the connecting member 28 that surrounds the space maintained in a vacuum, and a space (external space) at atmospheric pressure that surrounds the connecting member are present between the face plate 11 and the rear plate 12. Therefore, the vacuum vessel 10 is provided with an edge portion for surrounding the connecting member 28. In other words, the connecting member 28 is present between the internal space 29 of the vacuum vessel 10 and the edge portion of the vacuum vessel 10. The edge portion of the vacuum vessel 10 is composed of an edge portion of the rear plate 12 located to the outside of the region of the rear plate 12 adhered to the connecting member 28, and an edge portion of the face plate 11 located to the outside of the region of the face plate 11 adhered to the connecting member 28. In general, the surface area of the edge portion of the rear plate 12 is larger than that of the edge portion of the face plate 11 in order to connect the wiring of the electron-emitting device and the drive circuit. When forming (connecting) the vacuum vessel 10, one of the plates is pressed against the other plate while at least heating the connecting member 28 and the connecting portion between the rear plate 12 and the face plate 11. Consequently, bending occurs in the edge portions of each of the rear plate 12 and the face plate 11 after they have been connected due to unavoidable thermal stress when connecting, variations in the height of the bonding members 23 and the like. Since the surface area of the edge portion of the rear plate 12 is larger than the surface area of the edge portion of the face plate 11 as previously described, the edge portion of the rear plate 12 bends more than the edge portion of the face plate 11. This type of phenomenon is frequently observed in the case of employing a method for forming the vacuum vessel as previously described. FIG. 4 is a drawing schematically showing bending of the edge portion of the rear plate 12. More specifically, FIG. 4 is a schematic diagram based on data obtained by placing the vacuum vessel 10 horizontally on a flat stage with the rear plate 12 facing upward and measuring bending of the rear plate 12. Measurement of bending of the rear plate 12 can be carried out by measuring location coordinates in the direction of height with a laser displacement meter able to be moved horizontally over the vacuum vessel 10. In FIG. 4, measured location coordinates are plotted on the horizontal axis, while the amount of bending of the surface of the vacuum vessel 10 (amount of bending of the rear plate 12) is plotted on the vertical axis. Furthermore, the actual displacement of the horizontal axis is about 1000 mm, while the actual displacement of the vertical axis is about 2 mm. As shown in FIG. 4, considerable bending can be seen to occur in an edge portion 401 of the rear plate 12 that is oriented towards the back side of the vacuum vessel 10 (side away from the face plate 11). On the other hand, the amount of bending in a region 403 surrounded by the connecting member 28 is less than that of the edge portion 401, and can be seen to demonstrate a comparatively gentler shape. Furthermore, the region 403 specifically refers to a region located on the opposite side from a portion of the region on the side of the rear plate 12 that opposes the faceplate 11, the portion of the region being surrounded by the connecting member 28 (region located in the internal space of the vacuum vessel 10).

On the other hand, as shown in FIG. 11B, alight emitter layer 15 such as a phosphor is provided on the inside of the face plate 11 (side of the internal space). This light emitter layer 15 has light emitters R, G and B that emit red, green and blue light, and a matrix-like light shields 17. A metal back layer 20, which has for the main component thereof, aluminum, for example, and functions as an anode electrode, is formed on the light emitter layer 15. Moreover, a getter film 22 may be formed on the metal back layer 20. During a display operation, a prescribed anode voltage is applied to the metal back layer 20.

A large number of electron-emitting devices 18 that respectively emit an electron beam are provided on the surface of the rear plate 12 that opposes the face plate (the surface on the side of the internal space) as electron sources that excite the R, G and B light emitters of the light emitter layer 15. These electron-emitting devices 18 are arranged in the form of a matrix corresponding to pixels (light emitters R, G and B). Furthermore, surface conduction electron-emitting devices or field emission electron-emitting devices can be applied for the electron-emitting devices 18. A large number of wires 21 that drive the electron-emitting devices 18 are provided in the form of a matrix on the surface of the rear plate 12 on the side of the internal space, and the ends thereof are led outside the vacuum vessel 10 (see FIG. 11A).

A large number of long, narrow plate-like spacers 14 are arranged between the rear plate 12 and the face plate 11 in order to support atmospheric pressure that acts on these plates and maintain the space between the rear plate 12 and the face plate 11 (internal space 29) at a prescribed interval. In the case of defining the lengthwise direction (direction of the long side) of the face plate 11 and the rear plate 12 as a first direction X, and defining the direction perpendicular thereto (direction of width or direction of the short side) as a second direction Y, the plate-like spacers 14 extend in the first direction X. In other words, the lengthwise direction 110 of the plate-like spacers 14 is the first direction X. The large number of plate-like spacers 14 are arranged at a prescribed interval in the second direction Y. The interval in the second direction Y can be, for example, 1 to 50 mm. The spacers 14 can be composed of long, narrow glass plates or ceramic plates. In addition, a high resistance film may be arranged on the surface of the plates or surface irregularities may be provided in the plates as necessary. The height of the spacers 14 (length in the Z direction) is several times to ten or more times the width thereof (length in the second direction Y), and the length thereof (length in the first direction X) is several tens of times to several hundreds of times the height.

In a display panel and image display apparatus provided with the above-mentioned vacuum vessel, in the case of display an image, an anode voltage is applied to the R, G and B emitter layers through the metal back layer 20. In addition, electron beams emitted from the electron-emitting devices 18 are simultaneously accelerated by the anode voltage and made to collide with the light emitters. As a result, the corresponding R, G and B light emitters are excited and emit light to display a color image.

As shown in FIG. 11C, the light emitter layer 15 have a large number of rectangular light emitters R, G and B that emit red, blue and green light. The light emitters R, G and B are mutually repeatedly arranged with a prescribed gap there between in the first direction X, and light emitters of the same color are arranged with a prescribed gap there between in the second direction Y. The gap in the first direction X is set to be smaller than the gap in the second direction Y. A light shielding layer 17 has a rectangular frame portion 17*a* that extends along the edge portion of the face plate 11, and matrix portions 17*b* that extend in the form of a matrix between the light emitter layers R, G and B inside the rectangular frame portion.

Figure 1A:
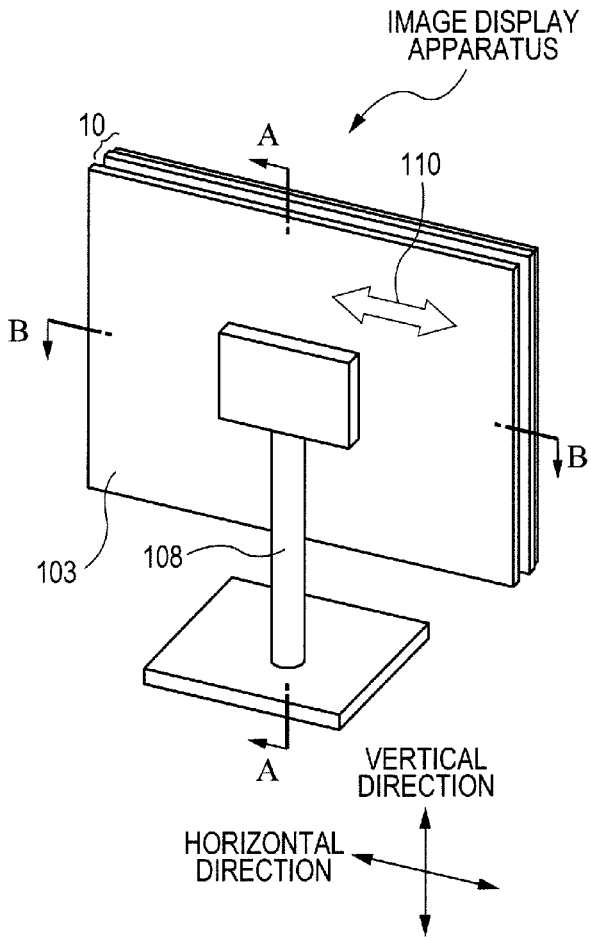
FIGS. 1A to 1C are schematic diagrams showing one form of an image display apparatus.
Figure 1B:
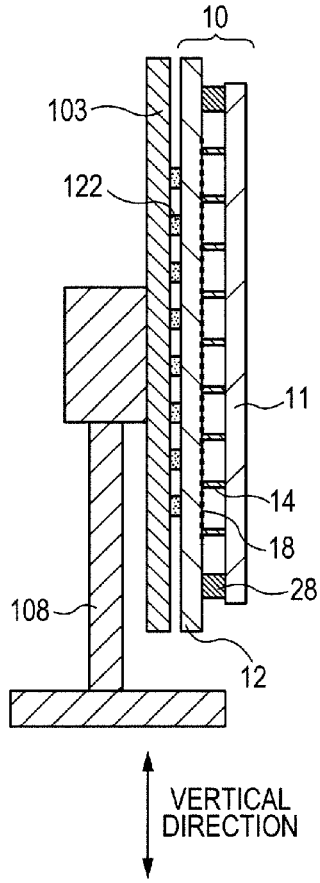
Figure 1C:
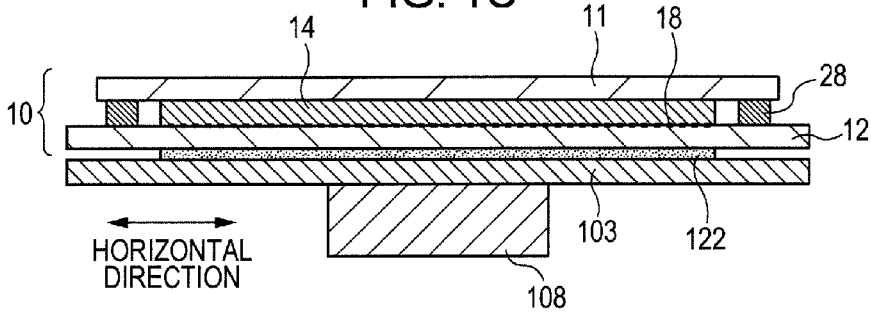

Next, an explanation is provided of an example of an image display apparatus to which the present invention is preferably applied using the schematic diagrams shown in FIGS. 1A to 1C. FIG. 1A is a schematic diagram of the entire image display apparatus as viewed from the back side, FIG. 1B is a cross-sectional schematic diagram taken along line A-A in FIG. 1A, and FIG. 1C is a cross-sectional schematic diagram taken along line B-B in FIG. 1A.

A fixing member 103 for fixing the vacuum vessel 10 to a rigid body in the form of a supporting member 108 is provided on the back of the vacuum vessel 10. Furthermore, the supporting member 108 can removably fix a display panel at least provided with the fixing member 103 and bonding members 122 in addition to the vacuum vessel 10. The bonding members 122 for adhering the fixing member 103 to the vacuum vessel 10 are provided on the back of the rear plate 12 of the vacuum vessel 10 (side on the opposite side from the face plate 11) as explained using FIG. 11. In this manner, the vacuum vessel 10 is supported by the rigid body in the form of the supporting member 108 through the fixing member 103. The supporting member 108 is provided with a support stand (pedestal) for placing the display panel on an installation surface such as a desk or audio rack on which the image display apparatus is installed, and a support column provided upright on the support stand for holding the display screen of the display panel vertical with respect to the installation surface. Namely, the base portion of the support column is fixed by the support stand. Furthermore, the support stand and the support column can be connected with screws and the like so as to be removable. The supporting member 108 can be further provided with an angle adjustment portion so as to be able to adjust the angle of the display screen in all four directions relative to the support column. In addition, a rotating mechanism capable of allowing rotation of the support column can also be provided on a base portion of the support column or the support stand. In addition, although an example of composing the support stand and the support column with separate members is shown here, the support stand and the support column can also be in the form of a single member. In addition, a plurality of support columns can also be provided.

Although printed circuit boards for driving the display panel are normally provided on the back side of the display panel (opposite side from the rear plate 12), the various types of printed circuit boards are omitted from FIG. 1 in order to facilitate explanation. In addition, a cover such as an external panel (not shown) is typically attached in addition to the configuration shown in FIG. 1 in order to improve appearance in actual image display apparatuses.

Figure 2:
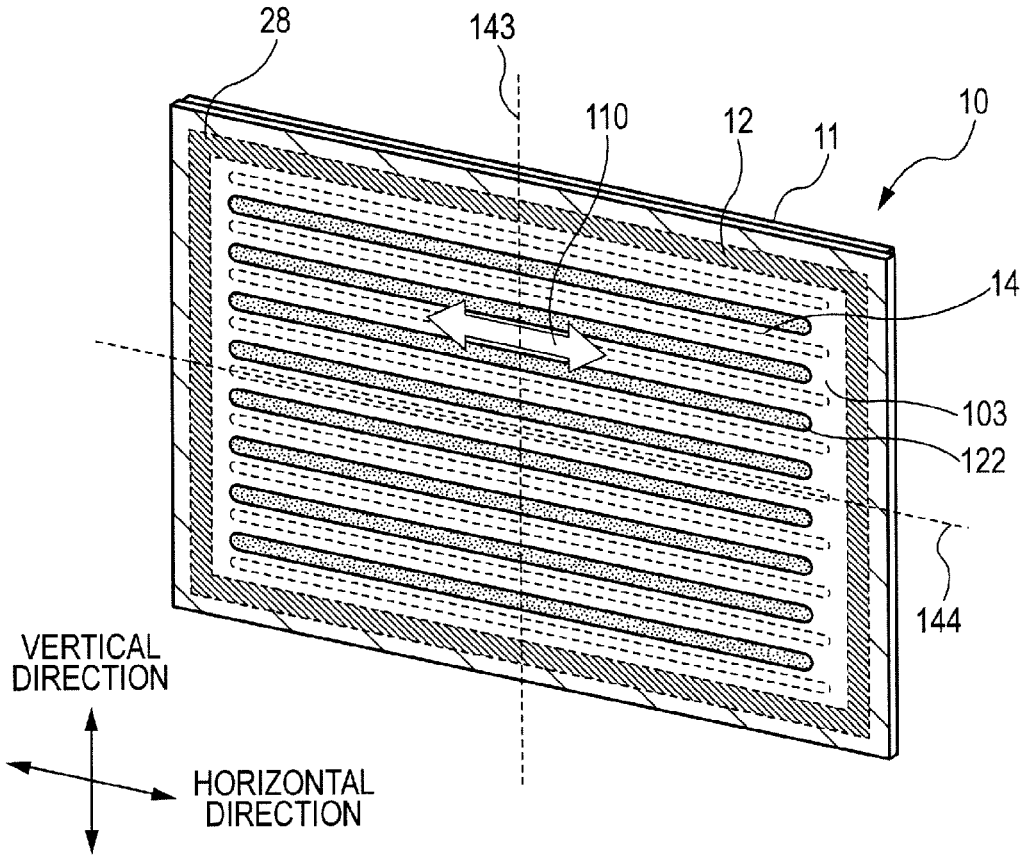
FIG. 2 is a schematic diagram showing the locations at which bonding members are arranged.

Next, an explanation of the locations at which the bonding members 122 are arranged with respect to the vacuum vessel 10 is provided using FIG. 2. FIG. 2 is a schematic drawing of the vacuum vessel 10 as viewed from the back side thereof. Furthermore, those members indicated with the same reference numerals in FIGS. 1 and 2 refer to the same members. In addition, the vertical direction and horizontal direction in FIG. 2 are the same as the vertical direction and horizontal direction in FIG. 1. Thus, the vertical direction corresponds to the second direction Y in FIG. 11A, while the horizontal direction corresponds to the first direction X in FIG. 11A. In addition, the arrows 110 in FIGS. 1 and 2 represent the lengthwise direction of long, narrow plate-like spacers 14 (spacer lengthwise direction) in the same manner as the arrow 110 shown in FIG. 11A. Namely, the lengthwise direction of the spacers in the examples of FIGS. 1 and 2 is the horizontal direction (width direction, lateral direction) of the image display apparatus.

As shown in FIG. 2, the plurality of the bonding members 122 are provided on the side of the rear plate 12 on the opposite side from the side that opposes the face plate 11. The plurality of the bonding members 122 are separated by prescribed intervals in the vertical direction, and each extends linearly along the horizontal direction. Namely, each of the bonding members 122 is provided along the lengthwise direction of the plate-like spacers 14 (so as to be parallel to the lengthwise direction of the plate-like spacers 14). Consequently, deformation of the spacers 14 when an impact has been applied to the vacuum vessel 10 from the supporting member 108 through the fixing member 103 and the bonding members 122 can be reduced as compared with the case of providing the bonding members 122 along a direction perpendicular to the lengthwise direction of the spacers 14. In addition, shear stress generated in portions contacted by the spacers 14 (spacer contact layers 40) to be described later can also be reduced in comparison with the case of providing the bonding members 122 in a direction perpendicular to the lengthwise direction of the spacers 14.

Figure 3:
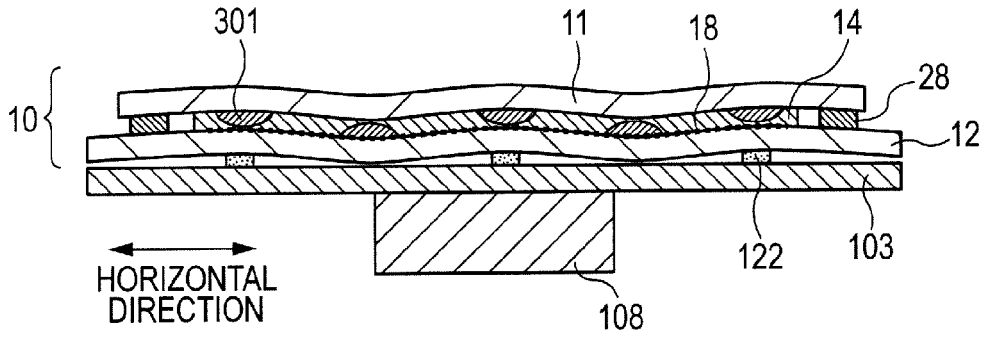
FIG. 3 is a schematic diagram showing a typical example of deformation that occurs during dropping impact.

FIG. 3 schematically shows a state when an impact has been applied from the supporting member 108 to the vacuum vessel 10 through the fixing member 103 and the bonding members 122 in a case where the bonding members 122 are provided along a direction perpendicular to the lengthwise direction of the spacers 14. Furthermore, FIG. 3 is a cross-sectional schematic diagram of the image display apparatus taken along the horizontal direction (lengthwise direction 110 of the spacers 14) in the same manner as the cross-sectional schematic diagram taken along line B-B of FIG. 1A (FIG. 1C). As shown in FIG. 3, if the bonding members 122 are provided along a direction perpendicular to the lengthwise direction of the spacers 14, when an impact is applied, the surfaces of the plates (11 and 12) deform into the shape of an irregular surface (undergo sine wave-like deformation) in a cross-section of the vacuum vessel 10 taken along the horizontal direction. At the same time, the spacers are also subjected to force that causes deformation into the shape of an irregular surface (sine wave-like deformation) in a cross-section taken along the horizontal direction of the vacuum vessel 10. Consequently, as shown in FIG. 3, portions 301 where stress concentrates periodically occur at those portions contacted by the spacers 14, the face plate 11 and the rear plate 12. There is increased susceptibility to the occurrence of damage to the spacers caused by application of force that causes the spacers to curve, and, as will be described later, the occurrence of damage to spacer contact portions due to the generation of shear stress in those portions contacted by the spacers (spacer contact portions) in the portions 301 where stress concentrates. On the other hand, as shown in FIG. 2, if each of the bonding members 122 is provided along the lengthwise direction of the plate-like spacers 14, deformation into the shape of an irregular surface as shown in FIG. 3 is inhibited in a cross-section taken along the horizontal direction of the vacuum vessel 10. Namely, in the form shown in FIG. 3, the bonding members 122 are (periodically) present at intervals in the cross-section taken along the horizontal direction. Consequently, when an impact is applied to the vacuum vessel 10 from the supporting member 108 through the contact members 122, although the impact is applied to those portions of the vacuum vessel 10 where the bonding members 122 are adhered, the impact is not applied to those portions where the bonding members 122 are not adhered. As a result, deformation occurs in the spacers 14 and the plates (11 and 12) as previously described. However, since the bonding members 122 are provided linearly along the lengthwise direction of the plate-like spacers 14 (see FIG. 1C), deformation into the shape of an irregular surface (sine wave-like deformation) is inhibited in the cross-section taken along the lengthwise direction of the spacers as shown in FIG. 3. Consequently, damage to the spacers and, as will be described later, damage to those portions contacted by the spacers (spacer contact portions) caused by the generation of shear stress therein, can be inhibited. Furthermore, in the case the bonding members 122 are provided along the lengthwise direction of the plate-like spacers 14, the surfaces of the plates (11 and 12) deform in the shape of surface irregularities (sine wave-like deformation). However, since deformation of the spacers 14 is inhibited as explained using FIG. 3, damage to the spacers and damage to the spacer contact portions can be inhibited. In addition, the bonding members 122 are preferably provided directly beneath the plate-like spacers 14 with the rear plate 12 there between in order to further inhibit the above-mentioned damage.

In addition, the bonding members 122 are provided only in a region located on the opposite side of a portion of the region on the side of the rear plate 12 that opposes the face plate 11, the portion of the region being surrounded by the connecting member 28 (region located in the internal space 29 of the vacuum vessel 10). Namely, when the side of the rear plate 12 that opposes the face plate 11 is defined as a first main side, and the side of the rear plate 12 on the opposite side from the first main side is defined as a second main side of the rear plate 12, then the bonding members 122 are provided only in a portion of the region of the second main side. A region that is a portion of the second main side refers to a region on the opposite side from the region of the first main side surrounded by the connecting member 28 (region located in the internal space of the vacuum vessel 10). In other words, a region that is a portion of the second main side refers to a region directly behind the region of the first main side surrounded by the connecting member 28 (region located in the internal space of the vacuum vessel 10). As a result of configuring in this manner, the bonding members 122 are not provided at the previously described edge portions of the vacuum vessel 10 where bending is large. Consequently, even if an impact is applied to the vacuum vessel 10 from the supporting member 108 through the fixing member 103 and the bonding members 122, damage to the edge portions of the vacuum vessel 10 can be avoided. In addition, since a load is not applied to the edge portions of the vacuum vessel 10 even when the fixing member 103 is adhered to the vacuum vessel 10, the number of opportunities for damage to the edge portions of the vacuum vessel 10 can be decreased. In addition, since the region where the bonding members 122 are provided is a comparatively flat surface as explained using FIG. 4, changes in the apparent height of the bonding members 122 can be reduced, thereby making it possible to adhere the fixing member 103 and the vacuum vessel 10 with good uniformity.

Double-sided adhesive tape or adhesive and the like can be used for the bonding members 122. The material, shape, thickness, surface area and the like of the bonding members 122 are suitably set in consideration of the strength, impact absorption and thermal conductivity of the bonding members 122 and flatness of the supporting member and so forth. A silicone-based, elastic resin adhesive, for example, can be used as an adhesive, while double-sided adhesive tape having an acrylic base can be used as double-sided adhesive tape. A silicone-based elastic resin adhesive in the form of TSE3944 (Momentive Performance Materials Japan LLC), for example, can be used for the silicone-based elastic resin adhesive. The creep property of the bonding members 122 is generally expressed as $\gamma c = A \times \tau \times t^{0.5}$ (where, $\gamma c$: shear creep strain, $\tau$: shear stress [Pa], t: time [sec]), and the value of A is preferably $1.0 \times 10^{-9}$ or less. If the amount of creep is excessively large, the vacuum vessel 10 ends up lowering from its initial fixed location over time, which is undesirable in terms of appearance. Providing the bonding members 122 with the creep property as described above prevents the vacuum vessel 10 from lowering from its initial fixed location over a long period of time even if the surface area of the bonding members 122 decreases considerably (such as to one-tenth or less the display surface area). Thus, the amount of adhesive used can be decreased considerably making it possible to realize an adhesive structure at low cost.

The plurality of bonding members 122 are arranged so as to satisfy linear symmetry by having a center line 144 in the horizontal direction of the image display region (or the rear plate 12) as the axis of symmetry thereof (see FIG. 2). At the same time, each of the bonding members 122 is arranged so as to satisfy a linear symmetrical relationship by having a center line 143 in the vertical direction of the image display region (or the rear plate 12) (second direction Y in FIG. 11A) as the axis of symmetry thereof. This relationship can also be said to be a relationship such that the image display region can be folded back in the vertical direction at the center line 143. Furthermore, the number of the bonding members 122 is two or more. In the case of using an odd number of bonding members (such as three), one of the bonding members is provided on the rear plate 12 so as to be located on the center line 144 in the horizontal direction of the image display region of the vacuum vessel 10, for example. The remaining bonding members are then arranged away from the bonding member provided on the center line 144 on the rear plate 12 so as to satisfy the above-mentioned two relationships.

The fixing member 103 can be composed of, a metal plate made of aluminum, iron or magnesium. Although the fixing member 103 is composed of a metal plate provided with a surface area roughly equal to that of the rear plate 12 in FIG. 1, the shape of the fixing member 103 is suitably designed according to the strength, required amount of heat dissipation and weight and so forth of the vacuum vessel 10.

Figure 5A:
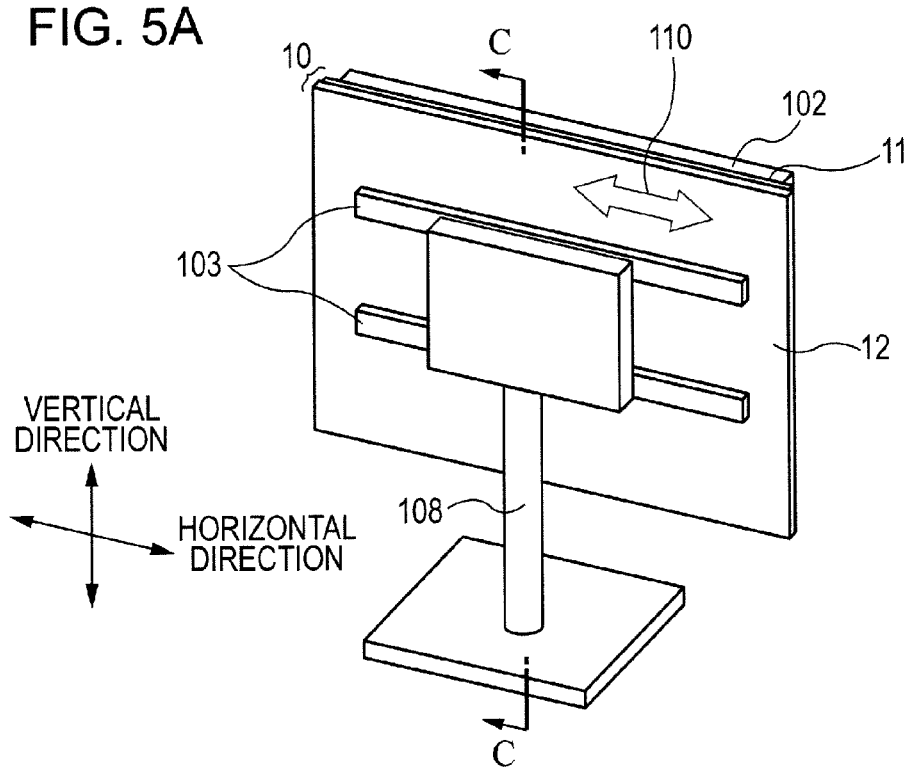
FIGS. 5A and 5B are drawings showing another form of an image display apparatus.
Figure 5B:
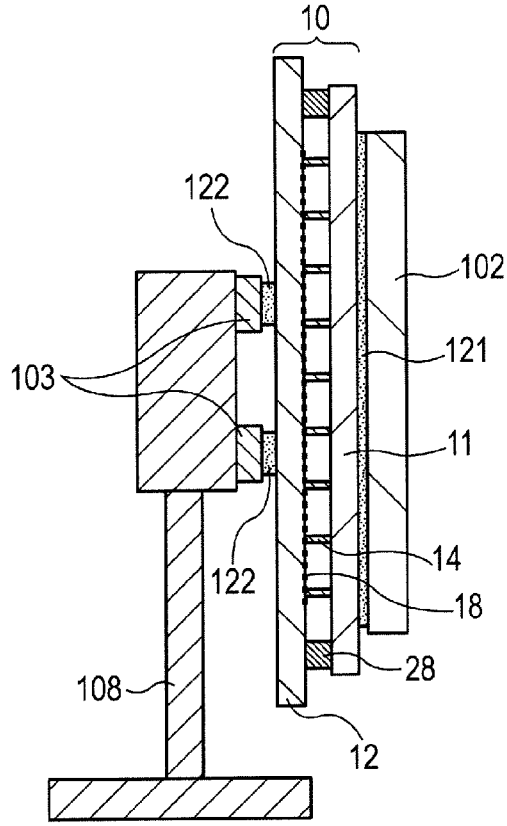

The fixing member can also be composed with a plurality of fixing members 103 as shown in FIG. 5A, for example. FIG. 5A is a schematic diagram of the entire image display apparatus as viewed from the back side in the same manner as FIG. 1A. FIG. 5B is a cross-sectional schematic diagram taken along line C-C of FIG. 5A. Furthermore, those members indicated with the same reference numerals in FIGS. 1 and 5 refer to the same members. In the case of using the plurality of fixing members 103, each fixing member 103 has a linear shape and is arranged so that the lengthwise direction thereof lies (parallel) in the horizontal direction (lengthwise direction 110 of the spacers 14). As a result of employing this configuration, an impact from the supporting member 108 can be applied to the vacuum vessel 10 by dispersing throughout all of the bonding members 122 extending in the lengthwise direction of the spacers. As a result, deformation in the shape of surface irregularities (sine wave-like deformation) in a cross-section along the lengthwise direction of the spacers 14 can be inhibited as previously explained using FIG. 3. On the other hand, if a plurality of linear fixing members 103 are provided so that the lengthwise direction thereof is parallel to the vertical direction, for example, the resulting form is substantially the same as the form in which the bonding members 122 are (periodically) present at intervals in the manner of FIG. 3. Consequently, deformation in the shape of surface irregularities (sine wave-like deformation) occurs in a cross-sectional taken along the lengthwise direction of the spacers 14.

Since the strength of the fixing members per se decreases in the case of using a plurality of fixing members 103 as shown in FIG. 5, in order to increase the strength of the vacuum vessel 10, a front plate 102, which is transparent to visible light, is preferably provided on the front of the face plate 11. Employing this configuration makes it possible to compensate for decreases in strength of the fixing members 103.

Figure 6:
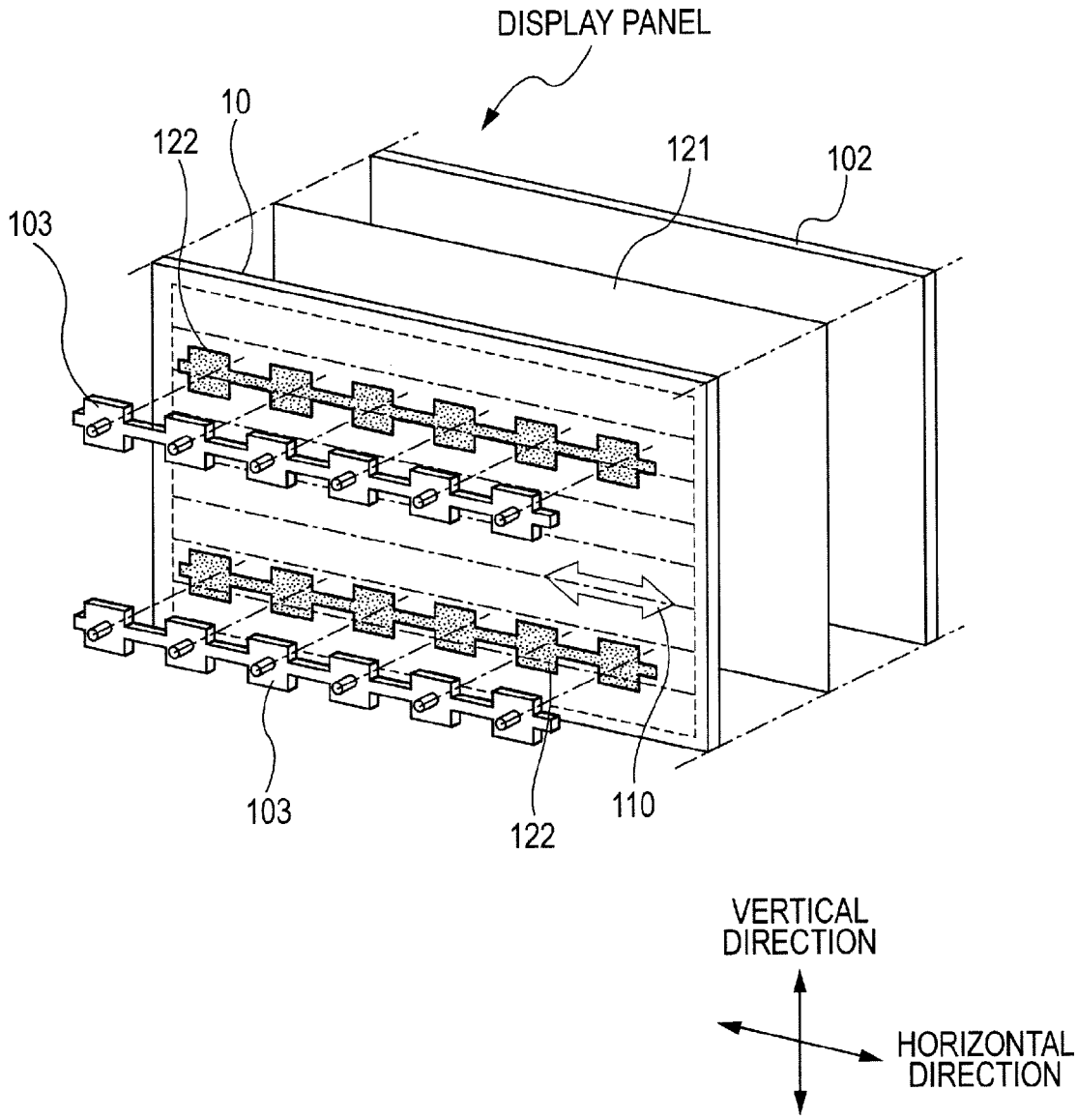
FIG. 6 is a drawing showing an example of an exploded view of a display panel.
Figure 7A:
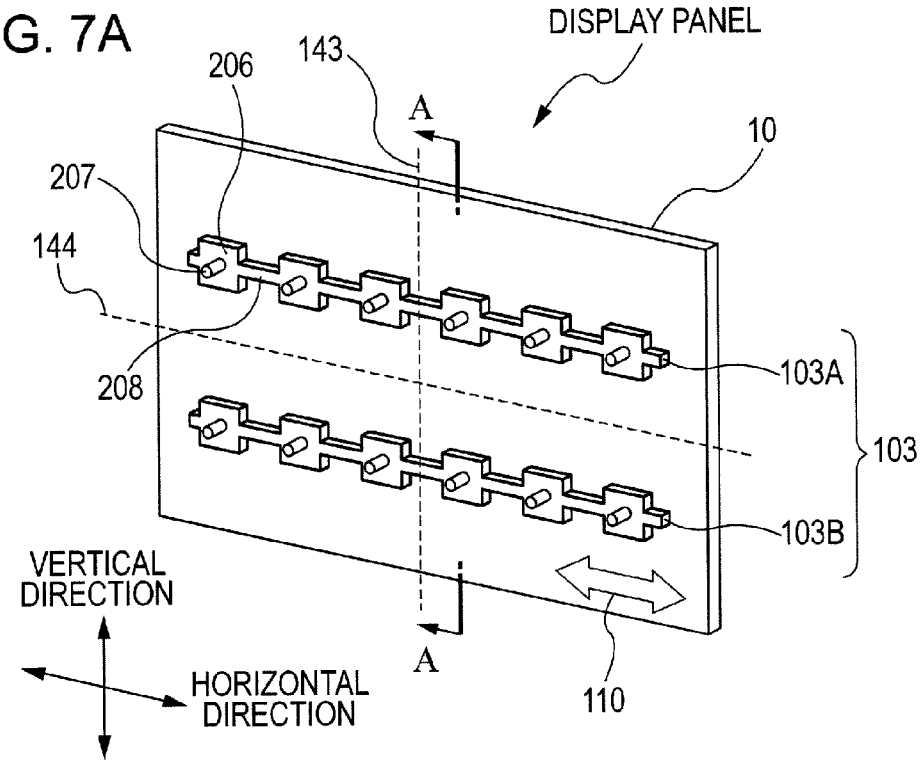
FIGS. 7A and 7B are drawings showing an example of the configuration of a display panel.
Figure 7B:
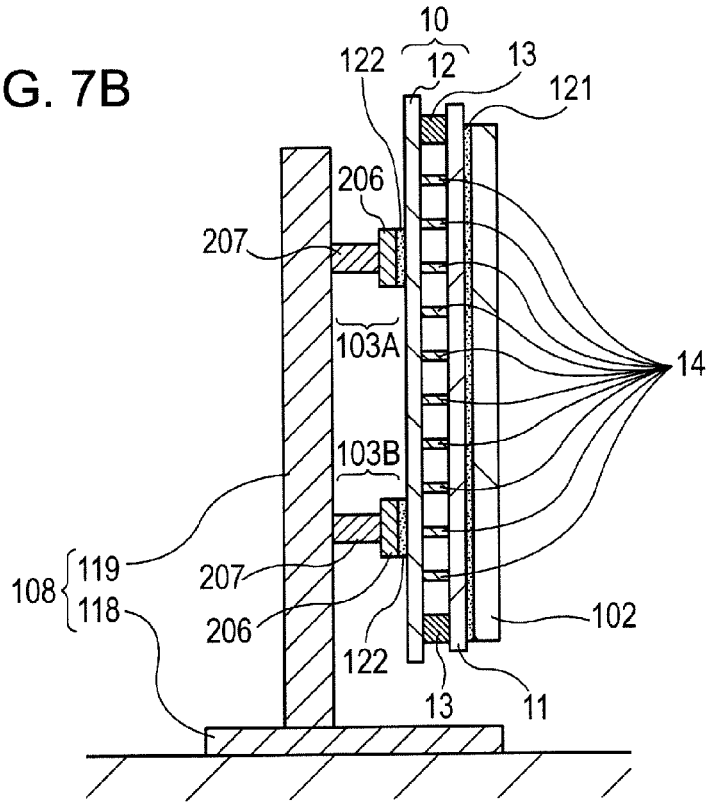

The following provides an explanation of a more detailed structure when using the plurality of fixing members 103 using FIGS. 6 and 7. Furthermore, those members using the same reference numerals in FIGS. 1, 6 and 7 indicate the same members. FIG. 6 is an example of an exploded view of a display panel when viewed from the back side. FIG. 7A is a perspective view of the back side of a display panel. FIG. 7B is a schematic diagram of a cross-section of an image display apparatus that includes a cross-section taken along the line A-A of FIG. 7A in an image display apparatus in which the supporting member 108 is attached to the display panel of FIG. 7A. Furthermore, a cover such as an external panel (not shown) is typically attached in addition to the configuration shown in FIG. 7B in order to improve appearance in actual image display apparatuses.

The plurality of fixing members 103 for fixing the vacuum vessel 10 to a rigid body in the form of the supporting member 108 are adhered to the back side of the rear plate 12 (side on the opposite side from the side (inside) that opposes the faceplate 11) using the bonding members 122. In this manner, the vacuum vessel 10 can be supported by the supporting member 108 through the plurality of fixing members 103. In addition, the arrows 110 in FIGS. 6 and 7A represent the lengthwise direction of long, narrow, plate-like spacers 14 (spacer lengthwise direction) in the same manner as the arrow 110 shown in FIG. 11A. Namely, the lengthwise direction of the spacers in the examples of FIGS. 6 and 7 is the horizontal direction (width direction, lateral direction) of the display panel.

In addition, the front plate 102 is adhered by a bonding member 121 to the surface of the front side of the face plate 11 of the vacuum vessel 10 (side on the opposite side from the side that opposes the rear plate 12). In the present embodiment, by arranging the lengthwise direction of the front plate 102, the lengthwise direction of the display panel 10 and the spacer lengthwise direction 110 to be parallel, deformation and concentration of stress in the spacer lengthwise direction 110 can be reduced. The front plate 102 is preferably in the form of a flat plate that is larger than the image display region (region or surface area in which the phosphors R, G and B are arranged) of the display panel (vacuum vessel 10). The front plate 102 is composed with a member that is transparent to visible light, and although a glass plate or polycarbonate plate, for example, can be used, a glass plate is particularly preferable from the viewpoint of optical characteristics. In order to give the vacuum vessel 10 a prescribed strength, the thickness of the front plate 102 is preferably 1.5 to 3.5 mm if it is composed of glass. In particular, the thickness of the front plate 102 is preferably set to be greater than the thicknesses of the face plate 11 and the rear plate 12 from the viewpoint of strength.

The material, shape, surface area and the like of the bonding member 121 is suitably set in consideration of the strength, impact absorption and thermal conductivity of the bonding member 121 and the flatness and the like of the front plate 102. Although there are no particular limitations on the bonding member 121, an adhesive that does not require high-temperature heating is preferably used to adhere the front plate 102 to the vacuum vessel 10 after forming the vacuum vessel 10. For example, a UV-curable resin adhesive can be used that is capable of adhering the front plate 102 composed of glass to the vacuum vessel 10 composed of glass at normal temperatures by irradiating with ultraviolet light. More specifically, an acrylic-based UV-curable resin adhesive can be used. Rigidity of the vacuum vessel 10, and particularly torsional rigidity in the planar direction, are increased by adhering the front plate 102 to the vacuum vessel 10 with the adhesive member 121. As a result, the thickness and weight of a conventionally required reinforcing member such as a reinforcing frame provided on the back of the rear plate 12 can be reduced considerably.

The plurality of fixing members 103 for fixing the vacuum vessel 10 to the rigid body in the form of the supporting member 108 are composed of two, mutually separated linear fixing members (103A and 103B) in the example shown in FIGS. 6 and 7. Each of the linear fixing members (103A and 103B) is arranged so that the lengthwise direction thereof is parallel to the lengthwise direction 110 of the plate-like spacers. As a result, deformation of the spacers 14 and concentration of stress in those portions where the spacers 14 contact the face plate 11 (to be subsequently described in detail) can be reduced.

The plurality of the fixing members 103 are arranged so that one of the fixing members 103A satisfies a linear symmetrical relationship with respect to the other fixing member 103B by having the center line 144 in the horizontal direction (first direction X of FIG. 11A) of the image display region (or rear plate 12) as the axis of symmetry thereof. At the same time, each of the fixing members is arranged so as to satisfy a linear symmetrical relationship by having the center line 143 in the vertical direction (second direction Y of FIG. 11A) of the image display region (or rear plate 12) as the axis of symmetry thereof. This relationship can also be said to be a relationship such that the image display region can be folded back in the vertical direction at the center line 143. Furthermore, although an example in which two fixing members (103A and 103B) are used is explained here, the number of the fixing members 103 is two or more. In the case of using an odd number of fixing members (such as three), one of the fixing members is adhered on the rear plate 12 so as to be located on the center line 144 in the horizontal direction of the image display region of the vacuum vessel 10, for example. The remaining fixing members are then arranged away from the bonding member provided on the center line 144 by being adhered on the rear plate 12 so as to satisfy the above-mentioned two relationships.

The bonding members 122 are preferably provided on the surface of the vacuum vessel 10 in the same shape as the fixing members. Furthermore, although the width of the bonding members 122 can be set arbitrarily, in order to ensure an adequate bonding surface area between the fixing members and the vacuum vessel 10, the bonding members 122 preferably have the same shape as images of the fixing members 103 orthogonally projected onto the surface of the vacuum vessel 10 (surface of the rear plate 12) as shown in FIG. 6. The locations where the bonding members 122 are arranged are provided only in a region on the backside of the region of the rear plate 12 surrounded by the connecting member 28 as explained using FIGS. 1 and 2. Consequently, the locations where the fixing members are arranged are also provided only in the region on the back side of the region of the rear plate 12 surrounded by the connecting member 28 as explained using FIGS. 1 and 2, in the same manner as the bonding members 122.

Each fixing member (103A and 103B) is provided with a plate-shaped member 206 and a protruding portion 207 provided on the plate-shaped member 206, and the protruding portion 207 is given the function of a supporting point. The protruding portions 207 are provided on the side on the opposite side from the side of the plate-like members 206 that adheres to the rear plate 12. As a result of employing this configuration, the rigid body in the form of the supporting member 108 is fixed to the plurality of the fixing members 103, and the display panel (vacuum vessel 10) is fixed to the supporting member 108. The plate-like members 206 and the protruding portions 207 are firmly connected, and the connecting method may be a method such as caulking, press-fitting, welding or adhesion. The width and/or surface area of the plate-like members 206 is set to be larger than the width and/or surface area of the base portions of the protruding portions 207 (portions fixed to the plate-like members 206) at least at those portions where the protruding portions 207 are provided (directly beneath the protruding portions 207). This is to reduce stress generated in the vacuum vessel when an impact is applied to the vacuum vessel 10 through the protruding portions 207.

The plate-like members 206 and the protruding portions 207 are preferably formed from a metal such as aluminum, iron or magnesium. The advantages of forming the plate-like members 206 and the protruding portions 207 from metal are as follows:

- the plate-like members 206 and the protruding portions 207 can be used as members that define ground for electrical circuits and the display panel;
- superior flame resistance; and,
- metal has superior strength.

In addition, favorable flatness can be obtained inexpensively by forming the plate-like members 206 by press-forming. The protruding portions 207 are able to function as interval-defining members, and the shape of the protruding portions 207 may be of any shape such as a cylindrical column, tetragonal column or polygonal column. A method such as header processing or machining can be used to fabricate the protruding portions 207. In addition, a structure can be provided in which thread cutting is carried out to give the protruding portions 207 the function of supporting points, and the fixing members (103A and 103B) firmly adhered to the vacuum vessel 10 are fixed to the supporting member 108 with screws. Although each fixing member (103A and 103B) is provided with six protruding portions 207, it is not necessary to use all of the protruding portions 207 for fixing to the supporting member 108. The numbers and locations of the protruding portions 207 used for fixing to the supporting member 108 can be suitably selected according to the shape and structure of the supporting member 108. For example, in the case of a supporting member 108 having a width in the horizontal direction that is equal to roughly half the width of the display panel, the two central protruding portions 207 among the six protruding portions 207 may be fixed to the supporting member 108. The greater the width in the horizontal direction of the supporting member 108 (support column 119), the greater the number of the protruding portions 207 or protruding portions 207 to the outside in the horizontal direction can be used for fixing. In addition, in the case of a supporting member 108 having a plurality of support columns 119, the protruding portions 207 can also be fixed to each of the support columns 119. In addition, caulking or press-fitting can be carried out at several locations at once by carrying out press-forming of the plate-like members 206 and the protruding portions 207 in combination. As a result, production cost of the fixing members can be reduced since the number of steps required for production can be decreased.

The supporting member 108 is provided with a support stand (pedestal) 118 for placing the display panel on an installation surface such as a desk or audio rack on which the image display apparatus is installed, and the support column 119 provided upright on the support stand 118 for holding the display screen of the display panel vertical with respect to the installation surface. Namely, the base portion of the support column 119 is fixed by the support stand 118. The supporting member 108 can be further provided with an angle adjustment portion so as to be able to adjust the angle of the display screen in all four directions relative to the support column 119. In addition, a rotating mechanism can be provided in the base portion of the support column 119 or in the pedestal 118 that allows rotation of the support column 119. In addition, although an example of composing the support stand 118 and the support column 119 with separate members is shown here, the support stand and the support column can also be in the form of a single member. In addition, a plurality of support columns 119 can also be provided.

Next, an explanation is provided of the configuration of the face plate 11 that contacts the spacers 14. A resistance adjustment layer 30 may be formed on the light shielding layer 17 shown in FIGS. 11B and 11C. The detailed configuration of the face plate 11 is schematically shown using FIG. 12. The resistance adjustment layer 30 is provided with a plurality of first resistance layers 31V, which extend in the second direction Y between light emitters respectively adjacent in the first direction X, and a plurality of second resistance adjustment layers 31H, which extend in the first direction X between light emitters respectively adjacent in the second direction Y, in the region of the matrix portions 17*b* of the light shielding layer 17. Since the light emitters are arranged in a row in the manner of R, G and B in the first direction X, the first resistance adjustment layers 31V have a narrower width than the second resistance adjustment layers 31H. For example, the width of the first resistance adjustment layers 31V is 40 μm, and the width of the second resistance adjustment layers 31H is 300 μm. Here, FIG. 12B is a cross-sectional view taken along line B-B of FIG. 12A, while FIG. 12C is a cross-sectional view taken along line C-C of FIG. 12A.

A thin film separation layer 32 is formed on the resistance adjustment layer 30. The thin film separation layer 32 has vertical line portions 33V formed on each of the first resistance adjustment layers 31V of the resistance adjustment layer 30, and horizontal line portions 33H formed on each of the second resistance adjustment layers 31H of the resistance adjustment layer 30. The thin film separation layer 32 is formed by containing a binder and particles dispersed at a suitable density so that the surface has surface irregularities, thereby separating a thin film (metal back) 20 subsequently formed by vapor deposition and the like. A phosphor or silica and the like can be used for the particles that compose the thin film separation layer 32. The thin film separation layer 32 is formed to be slightly thinner than the light shielding layer 17, and in terms of a numerical example, the width of the horizontal line portions 33H of the thin film separation layer 32 is 260 μm, while the width of the vertical line portions 33V is 20 μm.

After forming the thin film separation layer 32, smoothing is carried out using lacquer and the like to form a smooth metal back layer 20. The film for smoothing is burned away by baking after having formed the metal back layer 20.

Following smoothing, the metal back layer 20 is formed by vapor deposition or other thin film formation process. As a result, separated metal back layers 20*a*, which are two-dimensionally separated in the first direction X and the second direction Y, are formed by the thin film separation layer 32. The separated metal back layers 20*a* are located superposing each of the light emitters R, G and B. In this case, gaps between the separated metal back layers 20*a* are of nearly the same width as the widths of the horizontal line portions 33H and the vertical line portions 33V of the thin film separation layer 32, and are 20 μm in the first direction X and 260 μm in the second direction Y. Furthermore, the metal back layer 20 is omitted from FIG. 12A to avoid excessive complexity of the drawing.

A getter film 22 may also be formed superposing the metal back layer 20. In an FED, there are cases in which it is necessary to form the getter film 22 on a metal back layer in this manner to ensure the degree of vacuum over a long period of time. Since the action of the thin film separation layer is not lost after the metal back layer 20 is formed, the getter film 22 can be formed into separated getter films 22*a* that are two-dimensionally separated in a pattern similar to that of the metal back layer 20.

Figure 12A:
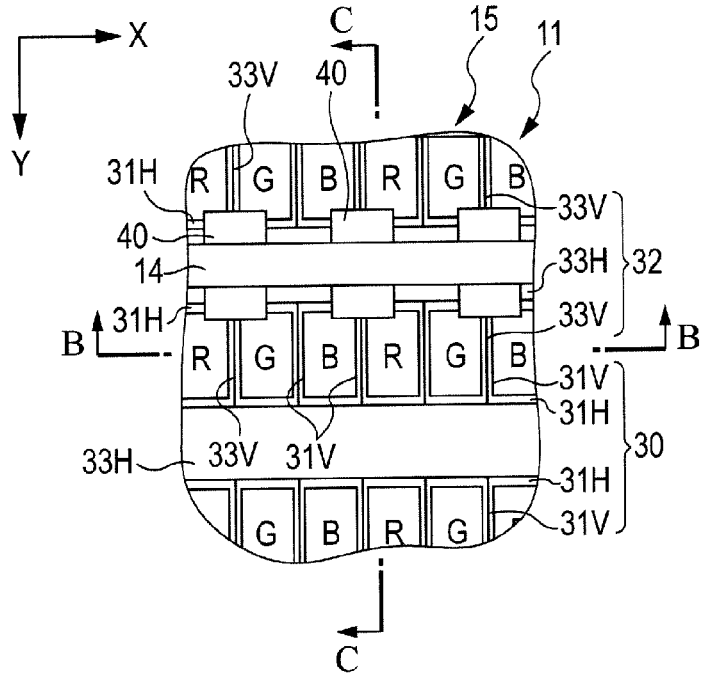
FIGS. 12A to 12C are schematic diagrams of a face plate of a display panel.
Figure 12B:
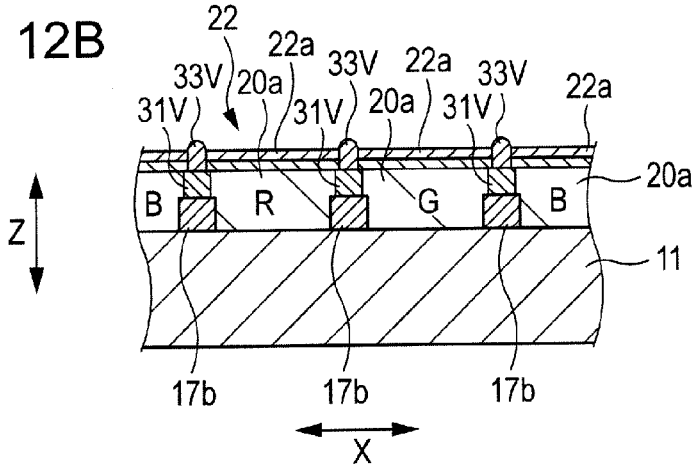
Figure 12C:
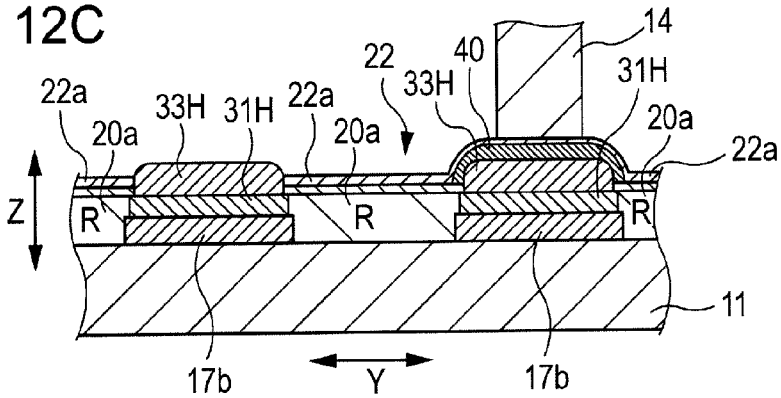

As shown in FIGS. 12A and 12C, each of the plurality of spacers 14 is arranged in opposition to the horizontal line portions 33H of the thin film separation layer 32. A spacer contact layer 40 is formed on each horizontal line portion 33H that opposes the spacers 14. Each spacer contact layer 40 is formed by, for example, printing a paste containing silver particles followed by baking. In addition to silver, conductive particles such as Pt or Au particles are also preferably applied. Since particles of an excessively small size cannot be formed in terms of printing accuracy, both end portions in the second direction Y of the spacer contact layers 40 slightly superpose four light emitter layers and separated metal back layers 20*a*, two of each of which are located on both sides of the horizontal line portions 33H in the second direction Y. In addition, the plurality of spacer contact layers 40 are intermittently provided at prescribed intervals in the first direction X as shown in FIG. 12A. The film thickness of the upper surface of the spacer contact layers 40 is adjusted so as to be thicker on the side of the rear plate 12 than the upper surface of the thin film separation layer 32. As a result, the spacers 14 are provided in contact with the spacer contact layers 40 without directly touching the thin film separation layer 32.

Although the spacer contact layers 40 are preferably electrically conductive from the viewpoints of contact with the spacers, preventing of charge accumulation and the like, the use of insulated spacer contact layers is also permitted. Furthermore, the thin film separation layer and resistance adjustment layer explained in the above-mentioned examples may be omitted depending on the form and fabrication method of the metal back 20. Alternatively, the spacer contact layers 40 may also not be provided in addition to the thin film separation layer and the resistance adjustment layer. In such cases, the spacers 14 contact the metal back 20 and the metal back serves as a spacer contact layer.

As was explained using FIG. 12, there are cases in which the spacers 14 contact the face plate 11 through the spacer contact layers 40. In such cases, there were cases in which damage was incurred by the image display apparatus due to impact to the image display apparatus from the outside, impact occurring during transport or installation, and impact caused by dropping the image display apparatus due to careless handling. More specifically, as explained using drawings such as FIG. 3, the vacuum vessel 10 undergoes deformation such as bending into the shape of protrusions or indentations in the Z direction shown in FIG. 11. Incidental to this deformation, members such as the spacer contact layers 40 or metal back 20 on the face plate 11 that are located at those portions contacted by the spacers 14 were subjected to shear force by the long, narrow plate-like spacers 14 causing them to be crushed. When members (such as the spacer contact layers 40 and the metal back) on the face plate 11 contacted by the spacers 14 are crushed, the fragments thereof drop onto the side of the rear plate 12, resulting in the occurrence of an undesirable electrical discharge between the metal back and the electron-emitting devices and between the separated metal backs. As a result, the image display apparatus was no longer able to function as an image display apparatus or displayed images deteriorated considerably.

However, in the image display apparatus as described above, even if an impact is applied to the vacuum vessel 10 from the supporting member 108, deformation of the spacers and shear stress generated in the contact portions of the spacers (spacer contact layers 40) can be reduced as previously explained using drawings such as FIG. 3. By reducing shear stress and the like in this manner, the above-mentioned image display apparatus no longer functioning as an image display apparatus and considerable deterioration of displayed images can be prevented. In addition, positioning the plurality of linear bonding members 122 and the plurality of linear fixing members 103 directly behind the spacers 14 with the rear plate 12 therebetween is even more desirable from the viewpoint of reducing stress. Moreover, the length of the plurality of linear bonding members 122 in a direction parallel to the lengthwise direction of the spacers 14 is preferably equal to or less than the length in the lengthwise direction of the spacers 14. The spacers 14 are provided traversing the image display region (the length in the lengthwise direction of the spacers 14 is longer than the length of the image display region in the lengthwise direction of the spacers 14). Here, the image display region is equivalent to a region in which the light emitters R, G and B are arranged (region of the light emitter layer 15) or region in which the electron-emitting devices are arranged. Consequently, the plurality of linear bonding members 122 are preferably provided only in the region that is a portion of the second main side of the rear plate and is on the opposite side from the region of the first main side in which the electron-emitting devices are arranged. Employing such a configuration is even more preferable from the viewpoint of reducing stress.

In the example shown in FIGS. 6 and 7, each of the fixing members (103A and 103B) is provided with alternating and continuous wide portions 206 and narrow portions 208. Here, the width of the narrow portions or wide portions refers to the length in the second direction Y (direction perpendicular to the lengthwise direction 110 of the spacers). In addition, the reason for providing the protruding portions 207 on the wide portions 206 is that stress applied to the vacuum vessel 10 is reduced as a result of stress being dispersed in the wide portions 206 when an impact such as dropping has been applied to the vacuum vessel 10 through the protruding portions 207. The surface area, shape and thickness of these wide portions 206, namely the portions having a large surface area, are suitably determined according to the rigidity of the vacuum vessel 10, predicted falling impact force and the like. In addition, the pitch and quantity of the protruding portions 207 are also suitably determined according to the rigidity of the vacuum vessel 10, allowed dropping impact force and the like. The pitch (interval) of the protruding portions 207 in the second direction Y (direction perpendicular to the lengthwise direction 110 of the spacers) is set to be larger than the pitch (interval) of the protruding portions 207 in the first direction X (direction parallel to the lengthwise direction 110 of the spacers). In terms of practical use, the pitch of the protruding portions 207 in the first direction X is set to be less than one-half the pitch of the protruding portions 207 in the second direction Y. Furthermore, the pitch of the protruding portions 207 in the second direction Y can be considered to be the pitch (interval) of two adjacent fixing members 103 among the plurality of fixing members 103 adhered to the rear plate 12 (namely, can be considered to be the interval between the fixing members 103A and 103B in the example of FIG. 7). As a result of setting in this manner, since stress along the lengthwise direction 110 of the spacers 14 can be reduced and deformation of the vacuum vessel can be inhibited when an impact is applied to the vacuum vessel 10 through the protruding portions 207, internal and external damage to the vacuum vessel 10 can be inhibited. On the other hand, if the pitch (interval) of the protruding portions 207 in the second direction Y is set to be smaller than the pitch (interval) of the protruding portions 207 in the first direction X, stress along the lengthwise direction 110 of the spacers 14 cannot be reduced thereby making this undesirable. This case is similar to the case of providing the linear fixing members so that the lengthwise direction thereof is along a direction perpendicular to the lengthwise direction 110 of the spacers.

Figure 8A:
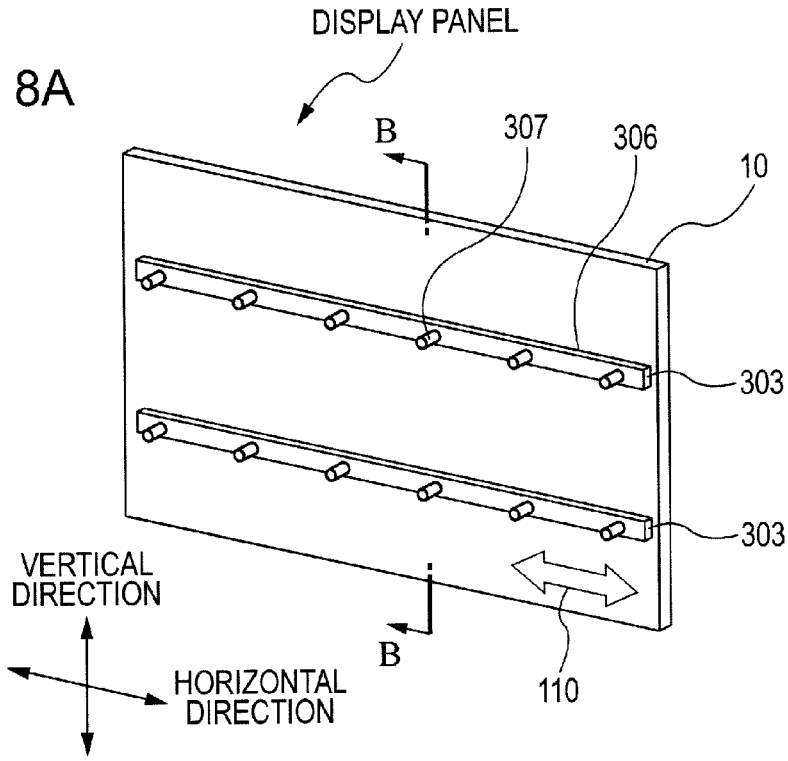
FIGS. 8A and 8B are drawings showing a first variation of fixing members.
Figure 8B:
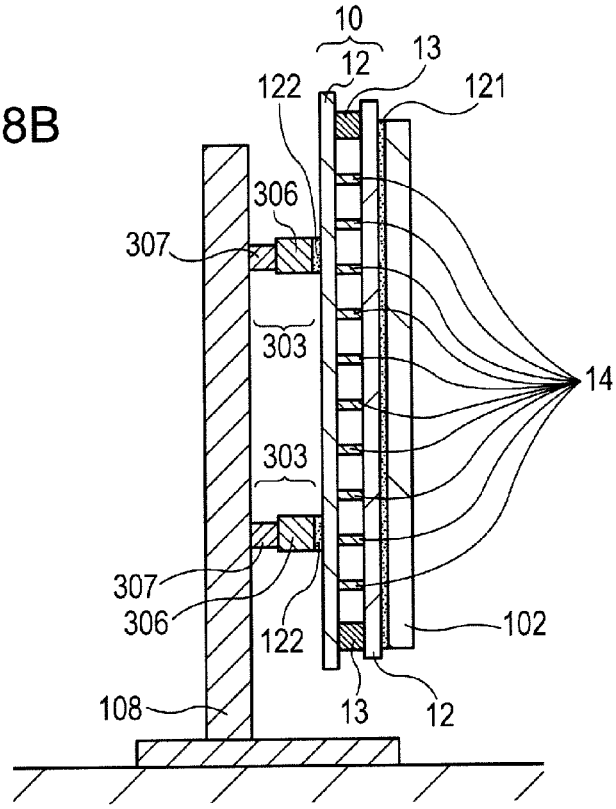

The following indicates variations of the linear fixing members 103 described above. In a first variation as shown in FIG. 8A, linear fixing members 303 can be composed of rod-like members 306 and protruding portions 307. FIG. 8A is a perspective view of the back side of a display panel. FIG. 8B is a cross-sectional schematic diagram of an image display apparatus using the vacuum vessel 10 of FIG. 8A in a cross-section corresponding to line B-B of FIG. 8A. Other aspects are the same as in the example explained using FIGS. 6 and 7. As a result of configuring in this manner, the range of molding methods that can be used for the fixing members 303 can be expanded, enabling them to be fabricated corresponding to the materials used. In addition, although the degree of freedom with respect to mounting printed circuit boards is inferior as compared with the example of FIGS. 6 and 7, design restrictions can be reduced as compared with the use of a conventional reinforcement frame.

Figure 9A:
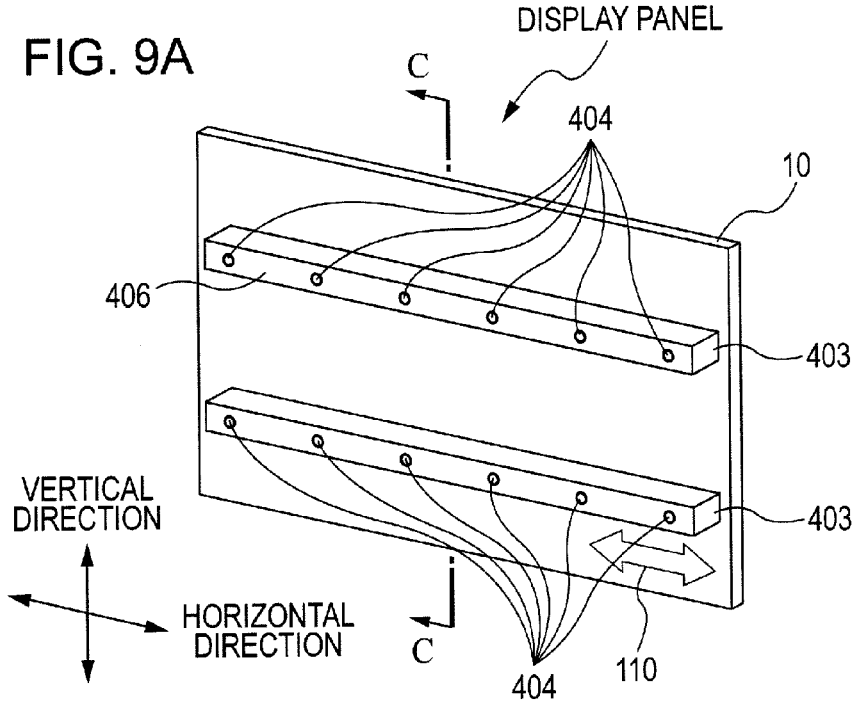
FIGS. 9A and 9B are drawings showing a second variation of fixing members.
Figure 9B:
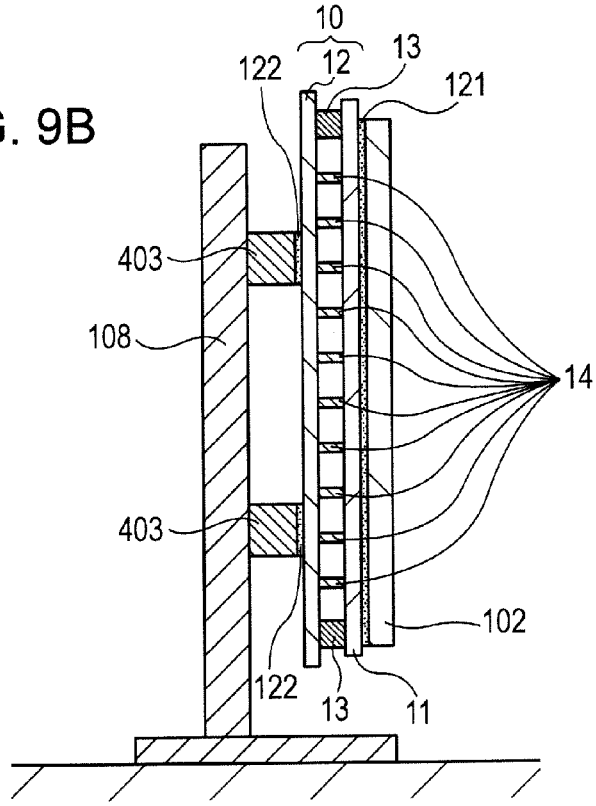

In a second variation as shown in FIG. 9A, linear fixing members 403 can be composed by thread cutting by using rod-like members 406 as supporting points 404. Thread cutting can be carried out on the rod-like members 406 by direct tapping or helisert processing. FIG. 9A is a perspective view of the back side of a display panel. FIG. 9B is a cross-sectional schematic diagram of an image display apparatus using the vacuum vessel 10 of FIG. 9A in a cross-section corresponding line C-C of FIG. 9A. Other aspects are the same as in the example explained using FIGS. 6 and 7. As a result of employing this configuration, although the degree of freedom with respect to mounting printed circuit boards is inferior as compared with the example of FIGS. 6 and 7, since the fixing members can be formed from a single part, cost reduction effects can be obtained for the fixing members.

Figure 10A:
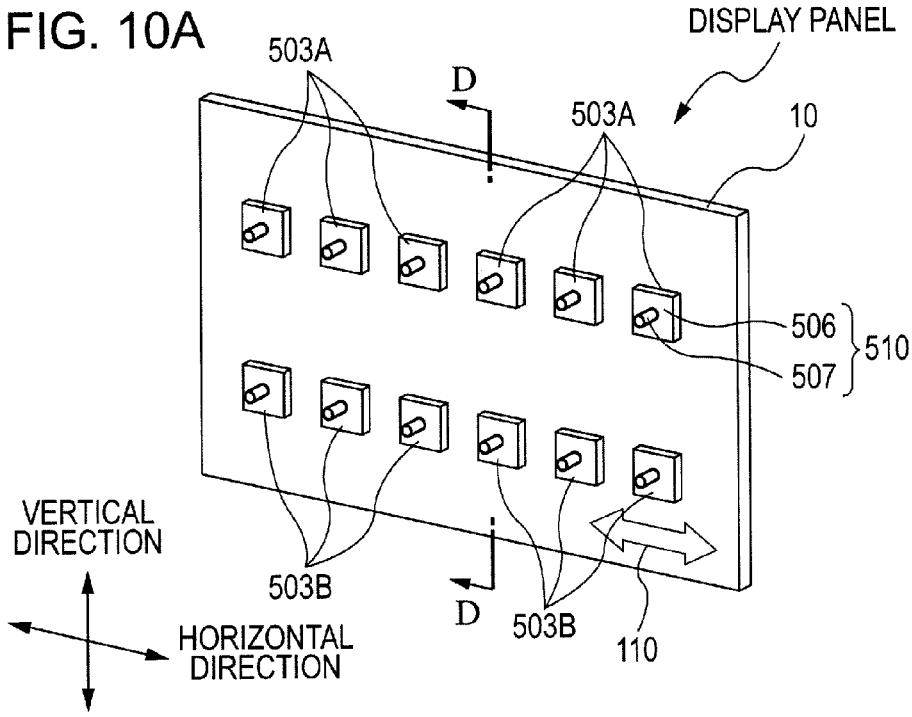
FIGS. 10A and 10B are drawings showing a third variation of fixing members.

In a third variation as shown in FIG. 10A, two fixing members (503A and 503B) can be composed by linearly arranging a large number of units 510 composed of plate-like members 506 and protruding portions 507. Each of the units 510 is provided with a plate-like member 506 and a protruding portion 507 fixed thereon. A plurality of the units 510 are adhered and fixed to the back of the vacuum vessel 10 so as to be mutually separated by a prescribed distance along the lengthwise direction 110 of the plate-like spacers 14 and so that a plurality thereof are arranged in the form of a line. Other aspects of this variation are the same as in the example explained using FIGS. 6 and 7. This third variation is equivalent to a configuration in which the narrow portions 208 that compose the fixing members 103 shown in FIGS. 6 and 7 have been removed (configuration in which wide portions and narrow portions are not connected). The pitch of the protruding portions is required to satisfy previously described pitch relationship.

Deformation of the spacers 14 within the vacuum vessel 10 and shear stress generated in those portions contacting the spacers 14 (spacer contact layers 40) can be reduced in the above-mentioned variations as well. The linear fixing members described above are substantially not provided with the conventional function as members for reinforcing the vacuum vessel in the manner of a reinforcement frame provided on the back of the vacuum vessel. The front plate 102 fulfills that role with respect to rigidity of the vacuum vessel 10, and particularly with respect to torsional rigidity in the planar direction. Consequently, a member in the manner of a complex and heavy reinforcement frame conventionally provided on the back of the vacuum vessel 10 is no longer required by the display panel or image display apparatus.

The following provides an explanation of specific examples. First, an explanation is provided of those matters common to the image display apparatuses as claimed in the following Examples 1 to 3. Fixing members (103 or 503) are adhered and fixed to the surface of the rear plate 12 (side open to the atmosphere) that composes the vacuum vessel 10 by means of the bonding members 122. Details of the vacuum vessel 10 are basically the same as those explained using FIGS. 11 and 12. The size of the image display region was 55 inches diagonally. In addition, surface-conduction electron-emitting devices were used for the electron-emitting devices 18. The electron-emitting devices 18 were respectively connected to scanning wiring and signal wiring formed by baking a conductive paste containing silver particles. The thickness of the face plate 11 and the rear plate 12 was 1.8 mm, and the interval between the face plate 11 and the rear plate 12 was 1.6 mm.

The vacuum vessel 10 was formed by connecting the face plate 11 and the rear plate 12 in a vacuum by means of the connecting member 28, and the inside of the vacuum vessel 10 was held at a pressure of $1.0\times10^{-5}$ Pa. The side wall 13 composed of glass and the bonding members 23 composed of indium were used for the connecting member 28. The face plate 11 and the rear plate 12 were connected by pressing the rear plate 12 against the face plate 11 while locally heating the bonding members in a vacuum chamber by irradiating with a laser. In addition, the plurality of long, narrow plate-like spacers 14 have the lengthwise direction 110 that is in the same direction as the lengthwise direction of the flat, rectangular vacuum vessel 10 (first direction X or horizontal direction). The plurality of long, narrow plate-like spacers 14 are arranged at intervals of 15 mm in a direction perpendicular to the lengthwise direction of the vacuum vessel 10 (second direction Y or vertical direction). The spacers 14 were composed of glass, and the thickness thereof was made to be 200 μm. The spacers 14 were provided on scanning wiring, and both end portions thereof in the lengthwise direction were fixed to the rear plate 12 by an inorganic adhesive (Aron Ceramic D, Toagosei Co., Ltd.). A silicone-based elastic resin adhesive in the form of TSE3944 (Momentive Performance Materials Japan LLC) was used for the bonding members 122. The silicone-based resin adhesive was coated at a thickness of 2 mm and width of 5 mm. In terms of practical use, for example, the coating thickness can be within the range of 1 to 5 mm and the width can be within the range of 0.5 to 5 mm. A silicone-based resin adhesive having a Young's modulus of 1 to 5 MPa and breaking elongation of 100% or more was used for the silicone-based resin adhesive.

EXAMPLE 1

In the present example, an image display apparatus was produced as shown in FIGS. 1 and 2. The plurality of bonding members 122 were linearly provided directly behind the plate-like spacers 14 so that the lengthwise direction thereof is parallel to the lengthwise direction 110 of the spacers. In addition, the plurality of bonding members 122 were provided only in the region on the back side of the region surrounded by the connecting member 28 of the rear plate 12 at mutual intervals of 30 mm. Subsequently, the fixing member 103, composed of an aluminum alloy plate having a thickness of 8 mm and surface area equal to that of the rear plate 12, was affixed to the back side (rear plate 12) of the vacuum vessel 10 by the bonding members 122. When affixing the fixing member 103 to the backside of the vacuum vessel 10, the bonding members 122 were pressed down to a thickness of 1 mm and width of 10 mm. Furthermore, when the fixing member 103 was affixed to the vacuum vessel 10, the bonding members 122 can be pressed down within a range of the thickness thereof 0.1 to 1.0 mm and within a range of the width thereof of 5 to 25 mm in terms of practical use.

The surface area over which the bonding members 122 are arranged can be made to be, for example, one-half the surface area of the rear plate 12. Subsequently, the fixing member 103 is adhered to the vacuum vessel 10 by curing the bonding members 122. The supporting member 108 was then fixed to the fixing member 103 by fastening with screws.

A vertical drop test from a height of 20 cm and a vibration test were carried out on the image display apparatus produced in the present example. Furthermore, the tests were carried out at that time such that impact and vibrations were directly applied to the supporting member 108 (so that impact and vibrations were applied to the vacuum vessel 10 from the supporting member 108 through the fixing member 103 and the bonding members 122). As a result, the vacuum vessel 10 was confirmed to be free of cracks, and stress lower than cracking stress of the vacuum vessel 10 was confirmed to have been generated. In addition, damage to the edge portions of the vacuum vessel 10 was also not observed. In addition, discharge phenomena was not confirmed when images were displayed with the image display apparatus after carrying out the vertical drop test as described above, and stable image display was able to be obtained over a long period of time. In addition, when the vacuum vessel 10 was disassembled, there was no damage to the spacers 14 and signs of crushing of the metal back 20 or spacer contact layers 40 by the spacers 14 were not observed.

EXAMPLE 2

The fixing member 103 used in the present example was provided with the configuration shown in FIG. 7. FIG. 7A is a perspective view of the back side of a display panel of the present example. FIG. 7B is a cross-sectional schematic diagram of the image display apparatus using the vacuum vessel 10 of FIG. 7A in a cross-sectional corresponding to line A-A of FIG. 7A. This example differs from Example 1 in that two linear fixing members (103A and 103B) are used and the front plate 102 is used. The configuration of the vacuum vessel 10 is the same as that of Example 1. The fixing member 103 used in this example is provided with the configuration shown in FIGS. 6 and 7. Two linear fixing members (103A and 103B) were adhered at mutual intervals to the back side of the rear plate 12 that composes the vacuum vessel 10 by the bonding members 122. Each of the fixing members (103A and 103B) are formed from plate-like members 206, which are composed by being alternately provided with a plurality of wide portions 206 and a plurality of narrow portions 208, and a plurality of protruding portions 207 fastened on each of the wide portions 206. The plate-like members 206 were formed by press forming. The protruding portions 207 were subjected to thread cutting to give them the function of supporting points for supporting the vacuum vessel 10 by fixing the vacuum vessel 10 to the supporting member 108. In the present example, the protruding portions 207 were formed by header processing. The plate-like members 206 and the protruding portions 207 were fixed by carrying out knurling processing and groove processing on the protruding portions 207 at those locations that contact the plate-like members 206 followed by carrying out indentation caulking from the back side.

The shape of the plate-like members 206 was such that the wide portions measured 60 mm high×60 mm across, while the narrow portions measured 10 mm high×140 mm across. In addition, the thickness of the plate-like members 206 was 2 mm. Here, although the thickness was set to 2 mm, if metal or an alloy is used for the material, the thickness in terms of practical use is preferably 1 mm or more to less than 30 mm and more preferably less than 10 mm. In addition, zinc-plated sheet steel was used for the material of the plate-like members 206. In addition, a single protruding portion 207 was fixed in the center of a single wide portion 206. Furthermore, the height of the top of the protruding portions 207 (portion at the greatest distance from the back side of the rear plate 12) from the back side of the rear plate 12 was 25 mm. In terms of practical use, the height of the protruding portions 207 from the back side of the rear plate 12 is 5 mm or more to less than 30 mm in consideration of the arrangement of circuit boards and the like. Stainless steel was used for the material of the protruding portions 207. In addition, the pitch in the horizontal direction of the protruding portions 207 (supporting points) was 200 mm. Two fixing members (103A and 103B) were provided at an interval on the back side of the vacuum vessel 10 (side of the rear plate 12 exposed to the atmosphere). Furthermore, although two fixing members (103A and 103B) were used in the present example, the number of fixing members can be two or more. In addition, although the pitch in the vertical direction of the protruding portions 207 (supporting points) was 420 mm in the present example, in terms of practical use, it is within the range of 400 to 430 mm. The locations of the fixing members 103 relative to the vacuum vessel 10 is such that one of the fixing members 103A satisfies a linear symmetrical relationship with respect to the other fixing member 103B having the center line 144 in the horizontal direction (lengthwise direction 110 of the plate-like spacers 14) of the image display region (or rear plate 12) of the vacuum vessel 10 as the axis of symmetry. In addition, each of the fixing members (103A and 103B) was arranged so as to have a linearly symmetrical relationship having the center line 143 in the vertical direction of the image display region (or rear plate 12) as the axis of symmetry (state such that the image display region can be folded back in the vertical direction at the center line 143). The protruding portions 207 were in the form of cylindrical columns having a diameter of 16 mm. Furthermore, the shape of the protruding portions 207 may also be a tetragonal column or polygonal column instead of a circular column. These dimensions can be varied according to the rigidity of the vacuum vessel 10, rigidity of the front plate 102, mechanical properties of the bonding member 121, mechanical properties of the bonding members 122, and rigidity of the plurality of fixing members 103, and proper values can be derived for these values. In the present example, the bonding members 122 were in the form of two linear members. The shape of the bonding members 122 was made to be the same as the shape of the fixing members 103A and 103B (same shape as images of the fixing members orthogonally projected onto the surface of the vacuum vessel) (see FIG. 6). The bonding members 122 were provided only in a region on the back side of the region of the rear plate 12 surrounded by the connecting member 28.

In addition, the rigidity of the fixing members 103 in the present example is less than that of the fixing members of Example 1. Consequently, the front plate 102 is adhered and fixed to the surface of the face plate 11 (side exposed to the atmosphere) that composes the vacuum vessel 10 using the bonding member 121 to increase the rigidity of the vacuum vessel 10. The front plate 102 is the same glass plate as that of the face plate 11 and the rear plate 12, and is larger than the image display region of the vacuum vessel 10. In the present example, the thickness of the front plate 102 was made to be 2.5 mm. Although the size was the same as that of the face plate 11, in the case of glass, the thickness is within the range of 1.5 to 3.5 mm. An acrylic-based UV-curable resin adhesive was used for the bonding member 121. More specifically, TB3042C (ThreeBond Co., Ltd.) was used for the bonding member 121. The acrylic-based UV-curable resin adhesive was coated over the entire surface of the side of the front plate 102 that opposes the face plate 11, and although it was coated to a thickness of 0.5 mm, in terms of practical use, the coating thickness is within the range of 0.1 to 1 mm. An advantage of combining the front plate 102 and the bonding member 121 in this manner is that reflection of external light and reflection of displayed images can be prevented in the image display apparatus.

A vertical drop test and vibration test were carried out on the image display apparatus produced in the present example in the same manner as in Example 1. As a result, the vacuum vessel 10 was confirmed to be free of cracks, and stress lower than cracking stress of the vacuum vessel 10 was confirmed to have been generated. In addition, stress generated in the vacuum vessel was able to be decreased by increasing the number of protruding portions 207 serving as supporting points. In addition, discharge phenomena was not confirmed when images were displayed with the image display apparatus after carrying out the vertical drop test as described above, and stable image display was able to be obtained over a long period of time. In addition, damage to the edge portions of the vacuum vessel 10 was also not observed. In addition, when the vacuum vessel 10 was disassembled, there was no damage to the spacers 14 and signs of crushing of the metal back 20 or spacer contact layers 40 by the spacers 14 were not observed.

In addition, the surface for mounting printed circuit boards was able to be made flat by employing the above-mentioned form for the plurality of the fixing members 103, and electrical circuits were able to be arranged at preferable locations without having to give hardly any consideration to the location of a reinforcement frame as in the prior art between the supporting member 108 and the rear plate 12. Consequently, design restrictions on electrical circuits were able to be reduced. An example of a design restriction is avoiding interference with the protruding portions 207. However, design restrictions were able to be diminished by drilling holes in a portion of a printed circuit board or plate to which a printed circuit board is fixed corresponding to the shape of the protruding portions 207, or by arranging printed circuit boards at locations where the protruding portions 207 were not present. In addition, effects resulting in considerable reductions in weight and costs of the display panel were able to be obtained in comparison with a reinforcement frame or other type of supporting member that was required in the prior art to obtain the same degree of strength for the display panel.

Furthermore, in a comparative example, two of the fixing members and bonding members 122 of the present Example 2 were rotated 90° (arranging so as be aligned in the vertical direction), and provided on the back of the rear plate 12 that composes the vacuum vessel 10. When a vertical drop test was carried out in the same manner as Example 1, a portion of the spacer contact layers 40 were confirmed to have been crushed by the spacers 14. In addition, damage to a portion of the spacers was also confirmed. Furthermore, the vertical direction refers to the direction perpendicular to the lengthwise direction 110 of the plate-like spacers 14.

EXAMPLE 3

Figure 10B:
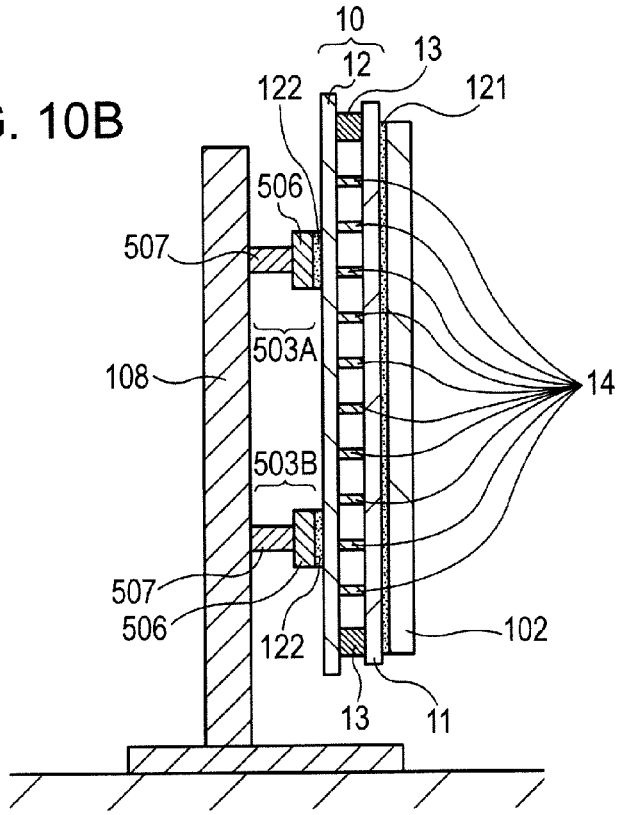

Two fixing members (503A and 503B) used in the present example are provided with the configuration shown in FIG. 10. The following provides an explanation of only those aspects of Example 3 that differ from Example 2. FIG. 10A is a perspective view of the back side of the vacuum vessel 10 in the present example. FIG. 10B is a cross-sectional schematic diagram of an image display apparatus using the vacuum vessel 10 of FIG. 10A in a cross-section corresponding to the line D-D of FIG. 10A. A plurality of units 510 each composed from plate-like members 506 and protruding portions 507 compose two fixing members (503A and 503B) by being arranged in two rows.

The present example is equivalent to a configuration in which the narrow portions 208 have been omitted (configuration in which wide portions and narrow portions are not connected) in comparison with Example 2. Thus, the plate-like members 506 in the present example are equivalent to the wide portions 206 in Example 2, and the plate-like members 506 measure 60 mm high×60 mm across. The protruding portions 507 in the present example are equivalent to the protruding portions 207 in Example 2. The units 510 are composed by fixing a single protruding portion 507 in the center of each plate-like member 506. In the present example, a single fixing member 503 was composed by arranging seven units 510 in a row in the horizontal direction (lengthwise direction 110 of the spacers 14) such that the pitch in the horizontal direction of the protruding portions 507 was 150 mm. Two fixing members 503 are adhered by the bonding members 122 on the back side (side of the rear plate 12 exposed to the atmosphere) of the vacuum vessel 10 so as to be separated in the vertical direction (direction perpendicular to the lengthwise direction 110 of the spacers 14). Furthermore, each unit was adhered so that the pitch in the vertical direction of the protruding portions 507 (supporting points) that compose each unit was 420 mm. Furthermore, although the number of the units 510 that compose a single fixing member (503A or 503B) is not limited to seven, the numbers of the units 510 that compose each row are preferably equal.

The plate-like members 506 (wide portions 206 in Example 2) and the protruding portions 507 (protruding portions 207 in Example 2) that compose the fixing members (503A and 503B) are formed in the same manner as Example 2. In addition, the shape, pitch of the supporting points, and method for fixing the plate-like members 506 and protruding portions 507 were also the same as in Example 2. In the present example, the shape of the bonding members 122 was made to be the same as the shape of the fixing members 503A and 503B (same shape as images of the fixing members orthogonally projected onto the surface of the vacuum vessel). The bonding members 122 were provided only in the region on the back side of region of the rear plate 12 surrounded by the connecting member 28.

When a vertical drop test was carried out in the same manner as Example 1, there was no damage to the spacers and signs of crushing of the metal back or spacer contact layers were not observed.

As a result of configuring the fixing members in the manner of the present example, the narrow portions 208 of Example 2 can be omitted, thereby further obtaining the effects of reducing the weight and cost of the display panel.

As has been described above, according to the present invention, deformation of the spacers and shear stress of spacer contact portions can be reduced and destruction of the vacuum vessel can be prevented even in cases in which strong impact such as dropping impact is applied to the image display apparatus. In addition, reduced thickness, light weight and lower costs of the image display apparatus can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-118971, filed on May 15, 2009, which is hereby incorporated by reference herein in its entirety.

What is claimed is:

1. A display panel comprising:

a vacuum vessel provided with a face plate, a rear plate having a first surface that opposes the face plate at an interval therefrom, a connecting member that surrounds a space between the face plate and the rear plate, is provided between the face plate and the rear plate and connects the face plate and the rear plate, and a plurality of plate-like spacers provided between the face plate and the rear plate so that lengthwise directions thereof are parallel to each other, and a fixing member adhered to the vacuum vessel by a plurality of linear bonding members provided on a second surface of the rear plate on an opposite side from the first surface, wherein each of the plurality of linear bonding members is provided on the rear plate at mutually prescribed intervals and along the lengthwise direction of the plurality of spacers, and the plurality of linear bonding members are provided only in a portion of a region on the second surface, the portion of the region being located on an opposite side from a region surrounded by the connecting member on the first surface, wherein the fixing member comprises a plurality of linear fixing members, each of which is adhered to the rear plate by the linear bonding members at mutually prescribed intervals and along the lengthwise direction of the plurality of spacers, wherein each of the plurality of linear fixing members is provided with a plate-like member adhered to the second surface and a plurality of protruding portions provided on a surface of the plate-like member on an opposite side from the rear plate.

2. The display panel according to claim 1, wherein the plate-like member is provided with a plurality of alternating wide portions and narrow portions provided along the lengthwise direction of the plurality of spacers, and the plurality of protruding portions are provided on the wide portions.

3. The display panel according to claim 2, wherein the wide portions and the narrow portions are connected.

4. The display panel according to claim 1, further comprising a front plate adhered to the face plate.

5. An image display apparatus comprising:

the display panel according to claim 1;

a supporting member that supports the vacuum vessel composing the display panel, by means of the fixing members;

light emitters provided on the face plate; and electron emitters provided on the rear plate.

6. A display comprising:

a display panel according to claim 1;

a light emitters provided on the face plate; and electron emitters provided on the rear plate.

* * * * *